US006479225B1

(12) United States Patent
Valvo et al.

(10) Patent No.: US 6,479,225 B1
(45) Date of Patent: Nov. 12, 2002

(54) CHROMOGENIC SEPIA SILVER HALIDE PRINT MATERIAL

(75) Inventors: David J. Valvo, Rochester, NY (US); Kurt M. Schroeder, Spencerport, NY (US); Michael R. Roberts, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/918,335

(22) Filed: Jul. 30, 2001

(51) Int. Cl.[7] ..... G03C 1/46

(52) U.S. Cl. ..... 430/505; 430/523; 430/558; 430/557; 430/552; 430/553; 430/546

(58) Field of Search ..... 430/505, 523, 430/558, 557, 552, 553, 546

(56) References Cited

U.S. PATENT DOCUMENTS

| | | | |
|---|---|---|---|
| 5,362,616 A | | 11/1994 | Edward et al. |
| 5,491,053 A | | 2/1996 | Barber et al. |
| 5,728,511 A | | 3/1998 | Hirosawa et al. |
| 5,939,247 A | | 8/1999 | Hirosawa et al. |
| 5,989,801 A | | 11/1999 | Hirosawa et al. |
| 5,994,050 A | * | 11/1999 | Maronian et al. ..... 430/584 |
| 6,368,759 B1 | * | 4/2002 | Bourdelais et al. ..... 430/15 |

FOREIGN PATENT DOCUMENTS

EP 0 600 377 A1 6/1994

* cited by examiner

*Primary Examiner*—Geraldine Letscher
(74) *Attorney, Agent, or Firm*—Sarah Meeks Roberts

(57) ABSTRACT

A silver halide photographic element for forming a sepia image comprising a support and an image forming layer which contains a cyan dye forming coupler, a magenta dye forming coupler and a yellow dye forming coupler, wherein the support has CIELAB a* and b* values within the following ranges at L*>90:0<b*<6.0, 0<a*<1.0, and wherein the image formed after exposure and development of the photographic element has CIELAB a* and b* values within the following ranges at each of the specified L* levels;

| | | |
|---|---|---|
| L* = 90 | 0 < a* < 4 | 0 < b* < 10 |
| L* = 75 | 2 < a* < 12 | 8 < b* < 18 |
| L* = 50 | 6 < a* < 25 | 10 < b* < 25 |
| L* = 25 | 10 < a* < 30 | 10 < b* < 25 |

27 Claims, No Drawings

CHROMOGENIC SEPIA SILVER HALIDE PRINT MATERIAL

FIELD OF THE INVENTION

This invention relates to photographic silver halide print media and, in particular, to chromogenic sepia print media developed in standard rapid color process chemistry.

BACKGROUND OF THE INVENTION

Chromogenic print media are formulated with one or more light sensitive silver halide layers, typically on reflective support. Each light sensitive layer develops to a hue comprised of a mixture of dyes when processed in standard Red color development chemistry. This is accomplished by co-dispersing cyan, magenta, and yellow dye-forming couplers in such a manner that the mixture of dyes formed during development combine to give the desired hue. In the current invention the desired hue is sepia, a color ranging firm yellow-brown to orange-brown. Other hues of commercial interest may be achieved by changing the relative proportions of the couplers in the co-dispersion.

Chromogenic photographic elements are described in the prior art. For example, U.S. Pat. No. 5,362,616 of J. L. Edwards et al describes the combination of ortho-aryloxy aniline derived yellow couplers in combination with pyrazolotriazoles for chromogenic black and white media. European Application 0 600 377 A1 of J. L. Edwards describes the use of yellow couplers derived from ortho-methoxy anilines. U.S. Pat. No. 5,728,511 of T. Hirosawa et al discloses the use of pyrazolotriazoles magenta couplers in combination with yellow couplers derived from ortho-chloro anilines and the use of certain sensitizing dyes. U.S. Pat. No. 5,939,247 of T. Hirosawa et al also discloses pyrazolotriazoles in combination with yellow couplers derived from ortho-chloro anilines. U.S. Pat. No. 5,491,053 of G. N. Barber et al teaches the combinations of pyrazolones with ortho chloro anilines for chromogenic black and white media. U.S. Pat. No. 5,728,511 of T. Hirosawa et al describes the use of a certain class of formalin scavenger and a specific triazine compound. U.S. patent application Ser. No. 09/633,610 filed on Aug. 7, 2000 discloses a chromogenic black and white element which produces images having improved thermal and light stability. Japanese Kokai 10-31274 describes a chromogenic black and white media which meets certain hue specifications.

There is still a need, however, for a chromogenic sepia media which provides visually pleasing images and which is also stable to light and heat. The inventors herein have discovered that one problem with chromogenic sepia media relates to the Dmin of the paper support the photographic multilayer is coated on. Typical color photographic reflection support is tinted to create the perception of a bright White Dmin. This is undesirable for sepia images because of the harsh visual contrast between the white background and the brown image tones. It also creates a much larger challenge in balancing the couplers utilized to form the sepia image.

SUMMARY OF THE INVENTION

This invention provides a silver halide photographic element for forming a sepia image comprising a support and an image dye forming unit which contains a cyan dye forming coupler, a magenta dye forming coupler and a yellow dye forming coupler; wherein the support has CIELAB a* and b* values within the following ranges at $L^*>90$:$0<b^*<6.0$, $0<a^*<1.0$; and wherein the image formed after exposure and development of the photographic element has CIELAB a* and b* values within the following ranges at each of the specified L* levels;

| | | |
|---|---|---|
| $L^* = 90$ | $0 < a^* < 4$ | $0 < b^* < 10$ |
| $L^* = 75$ | $2 < a^* < 12$ | $8 < b^* < 18$ |
| $L^* = 50$ | $6 < a^* < 25$ | $10 < b^* < 25$ |
| $L^* = 25$ | $10 < a^* < 30$ | $10 < b^* < 25$ |

ADVANTAGEOUS EFFECT OF THE INVENTION

The invention provides a chromogenic sepia reflective photographic paper material that, when developed in standard RA color development chemistry, produces images having improved and more visually pleasing sepia image quality. The invention has numerous advantages over prior chromogenic sepia media. The inventive photographic element forms an excellent image over a wide range of exposure times for conventional and digital exposure devices. In a preferred embodiment the image formed by the inventive media exhibits much improved thermal and light stability, maintaining good Dmins after extended incubation to heat or light. The inventive media also preserves the color lightness reproduction previously described in U.S. Pat. No. 5,362,616 which enhances perceived image quality. The preferred structure of the inventive media has a single imaging layer that provides for improved sharpness and developability, and it contains yellow dye-forming couplers that are more suitably matched in reactivity to couplers of general formula MEGENTA-2. The photographic paper support of the invention has a Dmin which enhances the image quality by lowering the color contrast between the background and sepia image tones. These and other advantages will be apparent from the detailed description below.

DETAILED DESCRIPTION OF THE INVENTION

A chromogenic sepia photographic imaging element has at least one dye imaging unit comprising a light sensitive silver halide emulsion, a cyan dye-forming coupler, a magenta dye-forming coupler, and a yellow dye-forming coupler, and produces when developed a monochrome image. The red, green, and blue light absorbing (RGB) components of the hue can be plotted as individual photographic curves (Status A density vs. relative log exposure) according to standard trade practices. Each curve is referred to in the current invention as either the red, green., or blue "dye curve". The red dye curve results primarily from the formation of cyan dye, the green dye curve primarily from the formation of magenta dye, and the blue dye curve primarily from the formation of yellow dye. The speed of each dye curve is the relative log exposure required to produce a Status A density of 0.8. Status A is the standard density unit used in the trade for reflection media. The preferred red, green, and blue dye curves of a sepia toned image do not overlap and do not have the same maximum densities (Dmax). In a single imaging layer, the speed of each dye curve depends in part on the relative reactivity of the co-dispersed couplers. The more reactive a coupler is relative to the other couplers in the co-dispersion, the greater the speed of its corresponding dye curve. When coupler reactivities are not matched, the dye curves do not align properly to form the desired hue at all densities.

The terms as used herein, "top", "upper", "emulsion side", "imaging side" and "face" mean the side or towards the side of an imaging member bearing the imaging layers or developed image. The terms "bottom". "lower side" and "back" mean the side or towards the side of the imaging member opposite from the side bearing the imaging layers or developed image. The term substrate as used herein refers to a support or base material that is the primary part of an imaging element such as paper, polyester, vinyl, synthetic paper, fabric, or other suitable material for the viewing of images. As used herein, the phrase "photographic element" is a material that utilizes photosensitive silver halide in the formation of images. The photographic elements are chromogenic sepia elements. Chromogenic sepia elements contain image dye-forming units sensitive to each of the three primary regions of the spectrum. Each unit can comprise a single emulsion layer or multiple emulsion layers sensitive to a given region of the spectrum. In one embodiment the image forming unit comprises three photosensitive layers. The layers of the element, including the layers of the image-forming units, can be arranged in various orders as known in the art. In an alternative format, the emulsions sensitive to each of the three primary regions of the spectrum can be disposed as a single segmented layer. The emulsions in this format are sensitized with a single color sensitizing and are substantially free of sensitizing dye of another color.

The silver halide photographic elements of the invention contain he appropriate amount and type of image couplers and the appropriate support described hereafter) for forming a sepia image which, after exposure and development of the photographic element, has CIELAB a* and b* values within the following ranges at each of the specified L* levels:

| | | |
|---|---|---|
| L* = 90 | 0 < a* < 4 | 0 < b* < 10 |
| L* = 75 | 2 < a* < 12 | 8 < b* < 18 |
| L* = 50 | 6 < a* < 25 | 10 < b* < 25 |
| L* = 25 | 10 < a* < 30 | 10 < b* < 25 |

More preferably the image formed after exposure and development of the photographic element has CIELAB a* and b* values within the following ranges at each of the specified L* levels:

| | | |
|---|---|---|
| L* = 90 | 0 < a* < 2 | 4 < b* < 8 |
| L* = 75 | 4 < a* < 8 | 8 < b* < 12 |
| L* = 50 | 6 < a* < 10 | 12 < b* < 18 |
| L* = 25 | 10 < a* < 16 | 12 < b* < 20 |

The development process which is utilized to determine whether a photographic element has the above CIELAB values is the well-known rapid access chemistry, the Kodak RA-4 developer process. The RA-4 process is described in the "British Journal of Photography Annual" of 1988, pages 198–199. The inventive element may be exposed by either conventional or digital devices. Exposure times may vary from 40 ns to several minutes.

For typical color photographic media and chromogenic black and white media, a white base with a slight bluish tint is preferred. The layers of the waterproof resin coating preferably contain colorants such as a bluing agent and magenta or red pigment. The bluish tint in typical color paper has CIELAB colorimetric values $-4.0<b^*<0$; $-1.0<a^*<1.0$, $L^*>93$. In contrast, the support utilized in the invention has CIELAB a* and b* values within the following ranges at $L^*>90$:$0<b^*<6.0$, $0<a^*<1.0$, and more preferably it has CIELAB a* and b* values within the following ranges at $L^*>90$:$0<b^*<2.5$, $0<a^*<0.8$. The support when defined using the CIELAB values is the support prior to coating with the image forming layers. These values provide a support which is more yellow in hue than the supports traditionally utilized for print materials. Various colorants may be added to the support to achieve the appropriate hue, particularly yellow colorants. In one preferred embodiment Yellow 110 pigment (Irgazin in yellow 3RLTN, from Ciba-Gigy was utilized. The above hue values may also be obtained by reducing or eliminating the white pigment which is ordinarily added to the support. Other methods of obtaining the desired CIELAB values ale known to those skilled in the art.

The reflective support of the present invention preferably includes a resin layer with a stabilizing amount of hindered amine extruded on the topside of the imaging layer substrate. Hindered amine light stabilizers (HALS) originate from 2,2,6,6-tetramethylpiperidine. The hindered amine should be added to the polymer layer at about 0.01–5% by weight of said resin layer in order to provide resistance to polymer degradation upon exposure to UV light. The preferred amount is at about 0.05–3% by weight. This provides excellent polymer stability and resistance to cracking and yellowing while keeping the expense of the hindered amine to a minimum. Examples of suitable hindered amines with molecular weights of less than 2300 are Bis(2,2,6,6-tetramethyl-4-piperidinyl)sebacate; Bis(1,2,2,6,6-pentamethyl-4-piperidinyl)sebacate; Bis(1,2,2,6,6-pentamethyl-4-piperidinyl)2-n-butyl-(3,5-di-tert-butyl-hydroxybenzyl)malonate; 8-Acetyl-3-dodecyl-7,7,9,9-tetramethyl-1,3,8-triazaspirol(4,5)decane-2,4-dione; Tetra(2,2,6,6-tetramethyl-4-piperidinyl)1,2,3,4-butanetetracarboxylate; 1-(-2-[3,5-di-tert-butyl-4-hydroxyphenyl-propionyloxyl]ethyl)-4-(3,5-di-tert-butyl-4-hydroxyphenylpropionyloxy)-2,2,6,6-tetramethylpiperidine; 1,1'-(1,2-ethenadiyl)bis(3,3,5,5-tetramethyl-2-piperazinone); the preferred hindered amine is 1,3,5-triazine-2,4,6-triamine,N,N'"-[1,2-ethanediylbis[[[4,6-bis(butyl(1,2,2,6,6-pentamethyl-4-piperidinyl)amino]-1,3,5-triazine-2-yl]imino]-3,1 propanediyl]]-bis[N',N"-dibutyl-N',N"-bis(1,2,2,6,6-pentamethyl-4-piperidinyl) which will be referred to as Compound A. Compound A is preferred because when mixtures of polymers and Compound A are extruded onto imaging paper, the polymer to paper adhesion is excellent and the long-term stability of the imaging system against cracking and yellowing is improved.

Suitable polymers for the resin layer include polyethylene, polypropylene, polymethylpentene, polystyrene, polybutylene, and mixtures thereof. Polyolefin copolymers, including copolymers of polyethylene, propylene and ethylene such as hexene, butene, and octene are also useful. Polyethylene is most preferred, as it is low in cost and has desirable coating properties. As polyethylene, usable are high-density polyethylene, low-density polyethylene, linear low density polyethylene, and polyethylene blends. Other suitable polymers include polyesters produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof Examples of suitable glycols include ethylene glycol, propylene glycol, butanediol, pentanediol, hexanediol, 1,4-cyclohexanedimethanol, diethylene glycol, other polyethylene glycols, and mixtures thereof. Other polymers are matrix polyesters having repeat units from terephthalic acid or naphthalene dicarboxylic acid and at least one glycol selected from ethylene glycol, 1,4-butanediol and 1,4-cyclohexanedimethanol such as poly (ethylene terephthalate), which may be modified by small amounts of other monomers. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510. Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

Any suitable white reflective material may be incorporated in the polyolefin layer, such as, for example, zinc oxide, zinc sulfide, zirconium dioxide, white lead, lead sulfate, lead chloride, lead aluminate, lead phthalate, antimony trioxide, white bismuth, tin oxide, white manganese, white tungsten, and combinations thereof. The preferred reflective material is titanium dioxide because of its high refractive index, which gives excellent optical properties at a reasonable cost. The reflective material is used in any form that is conveniently dispersed within the polyolefin. The preferred reflective material is anatase titanium dioxide. Another preferred reflective material is rutile titanium dioxide because it has the highest refractive index at the lowest cost. The average diameter of the rutile $TiO_2$ is most preferably in the range of 0.1 to 0.26 $\mu$m. Particle sizes that are less than 0.1 $\mu$m are not sufficiently opaque when dispersed in polymers. Preferably, the reflective material should be employed in the range of from about 10 to about 50 percent by weight, based on the total weight of the polyolefin coating. Below 10 percent $TiO_2$, the imaging system will not be sufficiently opaque and will have inferior optical properties. Above 50 percent $TiO_2$, the polymer blend is not manufacturable. The surface of the $TiO_2$ can be treated with an inorganic compounds such as aluminum hydroxide, alumina with a fluoride compound or fluoride ions, silica with a fluoride compound or fluoride ion, silicon hydroxide, silicon dioxide, boron oxide, boria-modified silica (as described in U.S. Pat. No. 4,781,761), phosphates, zinc oxide, $ZrO_2$, etc., and with organic treatments such as polyhydric alcohol, polyhydric amine, metal soap, alkyl titanate, polysiloxanes, silanes, etc. The organic and inorganic $TiO_2$ treatments can be used alone or in any combination. The amount of the surface treating agents is preferably in the range of 0.2 to 2.0% for the inorganic treatment and 0.1 to 1% for the organic treatment, relative to the weight of the titanium dioxide. At these levels of treatment the $TiO_2$ disperses well in the polymer and does not interfere with the manufacture of the imaging support.

The polymer, hindered amine light stabilizer, and the optional reflective material are mixed with each other in the presence of a dispersing agent. Examples of dispersing agents are metal salts of higher fatty acids such as sodium palmitate, sodium stearate, calcium palmitate, sodium laurate, calcium stearate, aluminum stearate, magnesium stearate, zirconium octylate, zinc stearate, etc., higher fatty acids, higher fatty amide, and higher fatty acids. The resin may also include a fluorescing agent, which absorbs energy in the UV region and emits light largely in the blue region. These include optical brighteners referred to in U.S. Pat. No. 3,260,715 or a combination thereof. The preferred embodiment of the current invention does not contain optical brighteners.

The resin may also contain an antioxidant(s) such as hindered phenol primary antioxidants used alone or in combination with secondary antioxidants. Examples of hindered phenol primary antioxidants include pentaerythrityl tetrakis [3-(3,5-di-tert-butyl-4-hydroxyphenyl)proprionate] (such as Irganox 1010), octadecyl 3-(3,5-di-tert-butyl-4-hydroxyphenyl)proprionate (such as Irganox 1076 which will be referred to as compound B), benzenepropanoic acid 3,5-bis(1,1-dimethyl)-4-hydroxy-2[3-[3,5-bis(1,1-dimethylethyl)-4-hydroxyphenyl)-1-oxopropyl)hydrazide (such as Irganox MD1024); 2,2'-thiodiethylenebis[3-(3,5-di-tert-butyl-4-hydroxyphenyl)-proprionate] (such as Irganox 1035), 1,3,5-trimethyl-2,4,6-tri(3,5-di-tert-butyl-4-hydroxybenzyl)benzene (such as Irganox 1330), but are not limited to these examples. Secondary antioxidants include organic alkyl and aryl phosphites including examples such as triphenylphosphite (such as Irgastab TPP), tri(n-propylphenyl-phophite) (such as Irgastab SN-55), and 2,4-bis(1,1-dimethylphenyl) phosphite (such as Irgafos 168).

The hindered amine light stabilizer, $TiO_2$, colorants, slip agents, optical brighteners, and antioxidant are incorporated either together or separately with the polymer using a continuous or Banburry mixer. A concentrate of the additives in the form of a pellet is typically made. The concentration of the rutile pigment can be from 20% to 80% by weight of the master batch. The master batch is then adequately diluted for use with the resin.

The support to which the waterproof resin layer may be laminated may be a polymeric, a synthetic paper, cloth, woven polymer fibers, or a cellulose fiber paper support, or laminates thereof. The base also may be a microvoided polyethylene terephthalate such as disclosed in U.S. Pat. Nos. 4,912,333; 4,994,312; and 5,055,371. The preferred support is a photographic grade cellulose fiber paper.

To form the waterproof resin coating, the pellet containing the pigment and other additives is subjected to hot melt coating onto a running support of paper or synthetic paper. If desired, the pellet is diluted with a polymer prior to hot melt coating. For a single layer coating, the resin layer may be formed by lamination. The die is not limited to any specific type and may be any one of the common dies such as a T-slot or coat hanger die. An exit orifice temperature in heat melt extrusion of the waterproof resin ranges from 500–660° F. Further, before coating the support with resin, the support may be treated with an activating treatment such as corona discharge, flame, ozone, plasma, or glow discharge.

The thickness of the resin layer which may be applied to a base paper of the reflective support used in the present invention at a side for imaging is preferably in the range of 5 to 100 $\mu$m and most preferably in the range of 10 to 50 $\mu$m. The thickness of the resin layer applied to a base paper on the side opposite the imaging element is preferably in a range from 5 to 100 $\mu$m and more preferably from 10 to 50 $\mu$m.

The surface of the waterproof resin coating at the imaging side may be a glossy, fine, silk, grain, or matte surface. On the surface of the waterproof coating on the backside which is not coated with an imaging element may also be glossy, fine, silk, or matte surface. The preferred waterproof surface for the backside away from the imaging element is matte.

Image dye-forming couplers are included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cya,in dyes on reaction with oxidized color developing agent. Others include the cyan couplers described in, for instance, European Patent Application Nos. 491,197; 544,322; 556,700; 556,777; 565,096; 570,006; and 574,948.

Typical cyan couplers in the prior art are represented by the following formulas:

CYAN-1

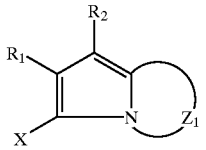

CYAN-2

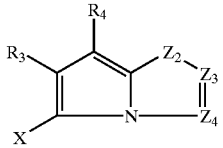

CYAN-3

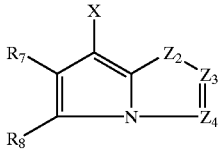

CYAN-4

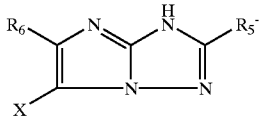

wherein $R_1$, $R_5$, and $R_8$ each represents a hydrogen or a substituent; $R_2$ represents a substituent; $R_3$, $R_4$, and $R_7$ each represents an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)═ and —N═; and $Z_3$ and $Z_4$ each represents —C($R_8$)═ and —N═.

The preferred cyan dye-forming couplers useful in the invention have the formula CYAN-5, a 2,5-diamido phenolic cyan coupler:

CYAN-5

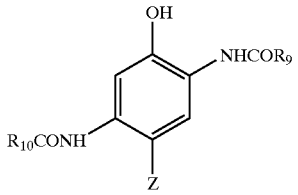

wherein $R_9$ and $R_{10}$ are independently selected from unsubstituted or substituted alkyl, aryl, amino, alkoxy and heterocyclyl groups; and Z is a hydrogen atom or a group which can be split off by the reaction of the coupler with an oxidized color developing agent.

In a further most preferred embodiment, the cyan coupler has the formula CYAN-5A:

CYAN-5A

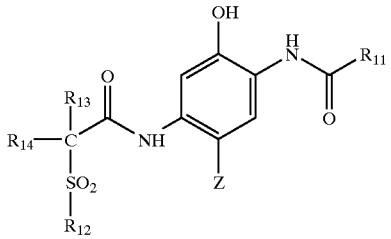

wherein $R_{11}$ and $R_{12}$ are independently selected from unsubstituted or substituted alkyl, aryl, amino, alkoxy, and heterocyclyl groups, and Z is as hereinbefore defined. $R_{13}$ and $R_{14}$ in CYAN-5A are independently hydrogen or an unsubstituted or substituted alkyl group. Typically, $R_{11}$ is an alkyl, amino, phenyl or aryl group. $R_{12}$ is desirably an alkyl or aryl group or a 5- to 10-membered heterocyclic ring which contains one or more heteroatoms selected from nitrogen, oxygen and sulfur, which ring group is unsubstituted or substituted.

It is preferred that the coupler of CYAN-5A is a 2,5-diamido phenol in which the 5-amido moiety is substituted in the alpha position by a particular sulfone (—$SO_2$—) group, such as, for example, described in U.S. Pat. No. 5,686,235. The sulfone moiety is an unsubstituted or substituted alkylsulfone or a heterocyclyl sulfone or it is an arylsulfone, which is preferably substituted, in particular, in the meta and/or para position.

Referring to formula CYAN-5A, $R_{13}$ and $R_{14}$ are independently hydrogen or an unsubstituted or substituted alkyl group, preferably having from 1 to 24 carbon atoms and, in particular, 1 to 10 carbon atoms, suitably a methyl, ethyl, n-propyl, isopropyl, butyl or decyl group or an alkyl group substituted with one or more fluoro, chloro, or bromo atoms, such as a trifluoromethyl group. Suitably at least one of $R_{13}$ and $R_{14}$ is a hydrogen atom. If only one of $R_{13}$ and $R_{14}$ is a hydrogen atom, then the other is preferably an alkyl group having 1 to 4 carbon atoms, more preferably 1 to 3 carbon atoms, and desirably 2 carbon atoms.

As used herein and throughout the specification unless where specifically stated otherwise, the term "alkyl" refers to an unsaturated or saturated straight- or branched-chain alkyl group, including alkenyl, and includes aralkyl and cyclic alkyl groups, including cycloalkenyl, having 3 to 8 carbon atoms and the term "aryl" includes specifically fused aryl.

In formula CYAN-5A, $R_{11}$ is suitably an unsubstituted or substituted amino, alkyl or aryl group or a 5- to 10-membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, $R_{11}$ is a 4-chlorophenyl, 3,4-di-chlorophenyl, 3,4-difluorophenyl, 4-cyanophenyl, 3-chloro-4-cyanophenyl, pentafluorophenyl, or a 3- or 4-sulfonamidophenyl group.

In formula CYAN-5A, when $R_{13}$ is alkyl, it may be unsubstituted or substituted with a substituent such as halogen or alkoxy. When $R_{13}$ is aryl or a heterocycle, it may be substituted.

In formula CYAN-5A, when $R_{13}$ is a phenyl group, it may be substituted in the meta and/or para positions with one to three substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxycarbonylamino and alkyl- or aryl-carbamoyl groups.

In particular, each substituent may be an alkyl group such as methyl, t-butyl, heptyl, dodecyl, pentadecyl, octadecyl or 1,1,2,2-tetramethylpropyl, an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy, an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form, e.g., polyalkylene oxides.

In formula CYAN-5 or CYAN-5A, Z is preferably a group which can be split off by the reaction of the coupler with an oxidized color developing agent, known in the photographic art as a 'coupling-off group' and may be hydrogen but is preferably chloro, fluoro, substituted aryloxy or mercaptotetrazole, and most preferably chloro.

The presence or absence of such groups determines the chemical equivalency of the coupler, i.e., whether it is a 2-equivalent (Z not hydrogen) or 4-equivalent (Z=hydrogen) coupler, and its particular identity can modify the reactivity of the coupler. Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766; and in U.K. Patent Nos. and published applications 1,466,728; 1,531,927; 1,533,039; 2,066,755A, and 2,017,704A. Halogen, alkoxy, and aryloxy groups are most suitable.

Examples of specific coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

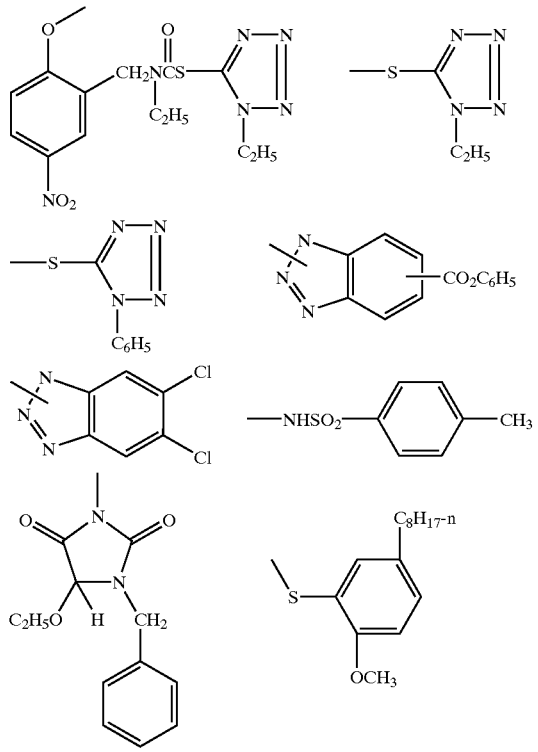

-continued

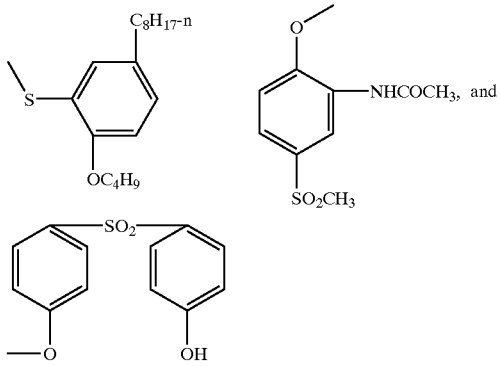

Typically, the coupling-off group is a chlorine atom or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus, the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention, $R_1$ in formula CYAN-5A is a small alkyl group or hydrogen. Therefore, in these embodiments the ballast would be primarily located as part of the other groups. Furthermore, even if the coupling-off group Z contains a ballast, it is often necessary to ballast the other substituents as well, since Z is eliminated from the molecule upon coupling, thus, the ballast is most advantageously provided as part of groups other than Z.

The following examples illustrate the preferred cyan couplers of the invention. It is not to be construed that the present invention is limited to these examples.

IC-1

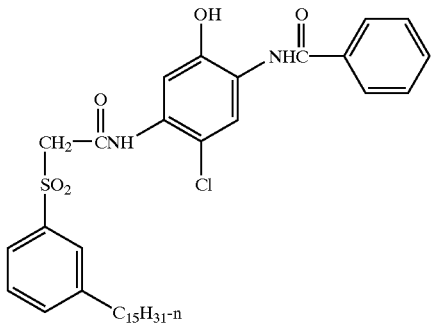

-continued

IC-2

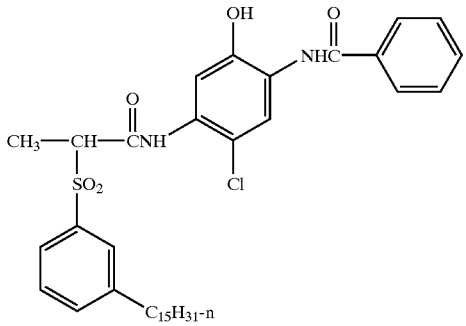

IC-3

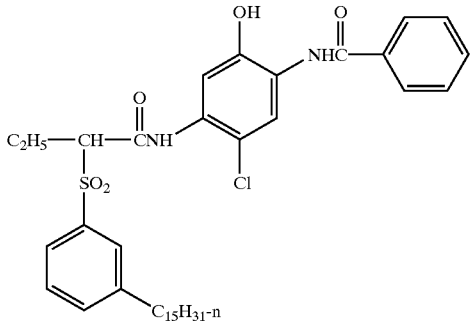

IC-4

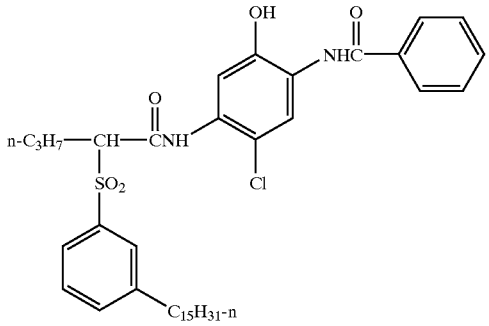

IC-5

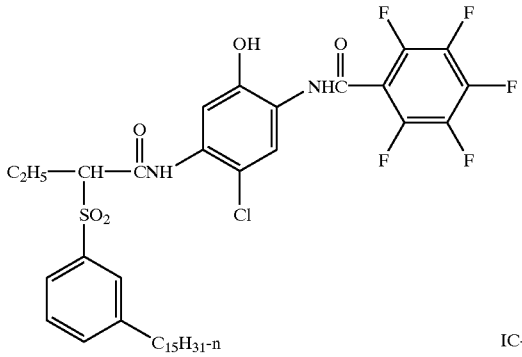

IC-6

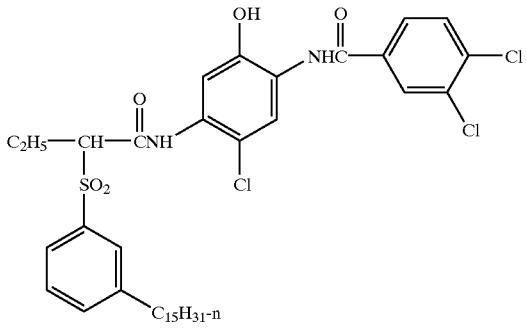

-continued
IC-7
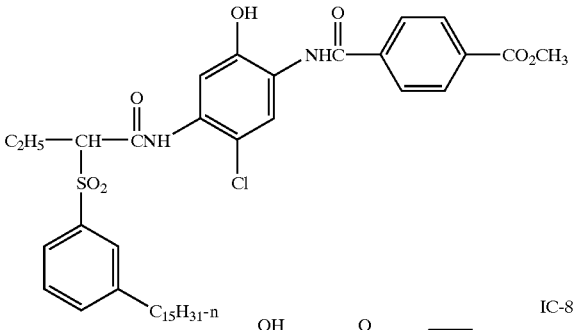
IC-8
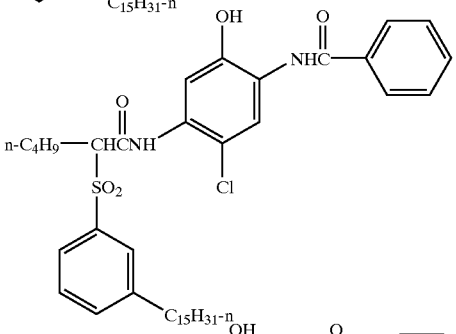
IC-9
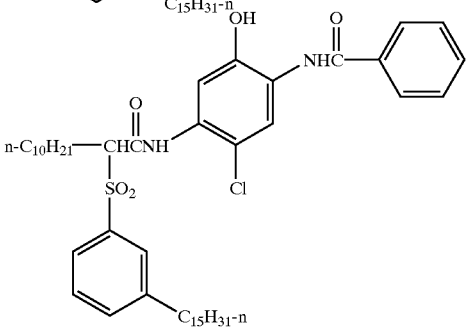
IC-10
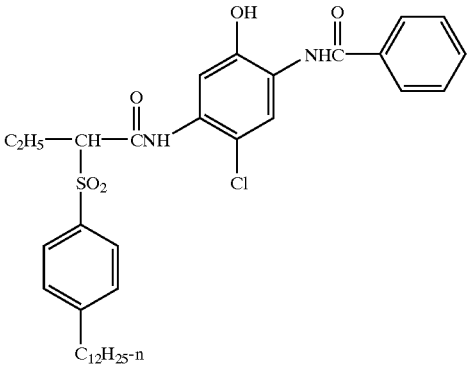
IC-11
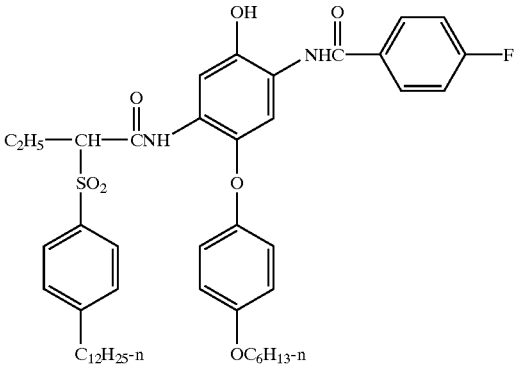
-continued
IC-12
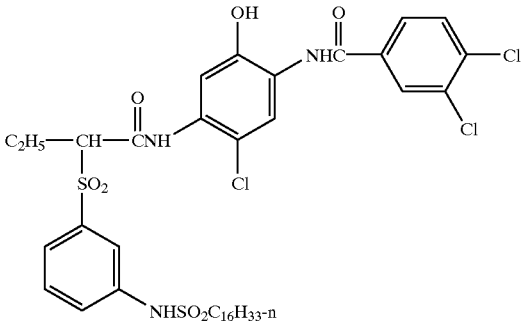
IC-13
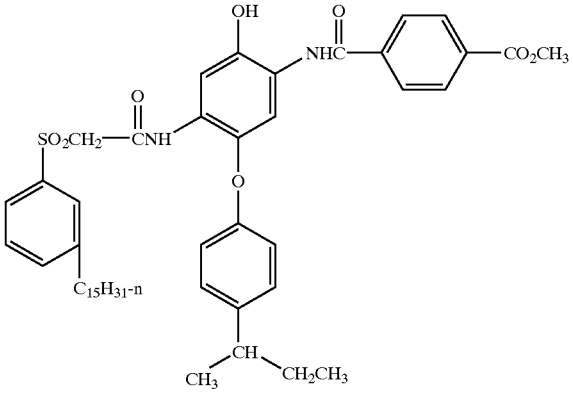
IC-14
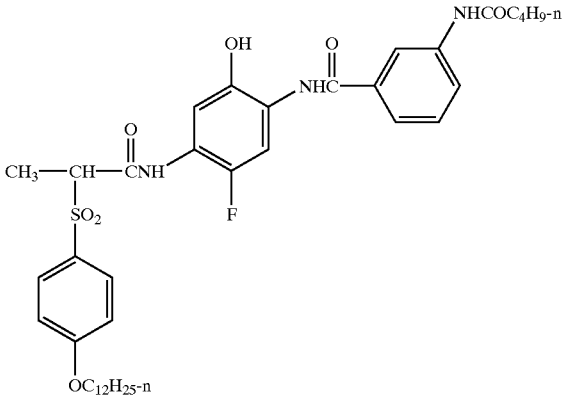
IC-15
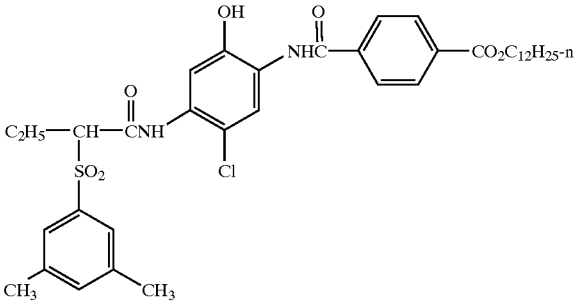

-continued
IC-16
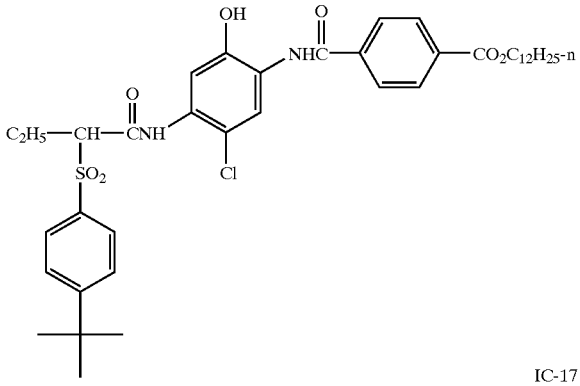
IC-17
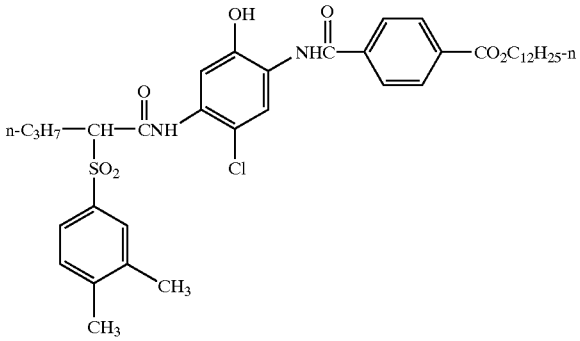
IC-18
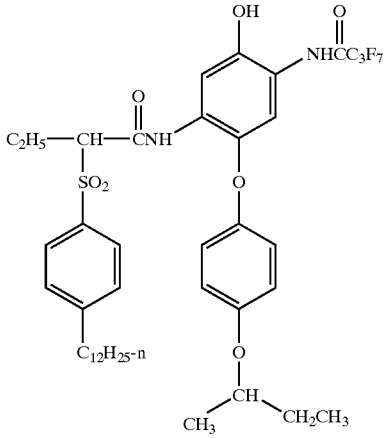
IC-19
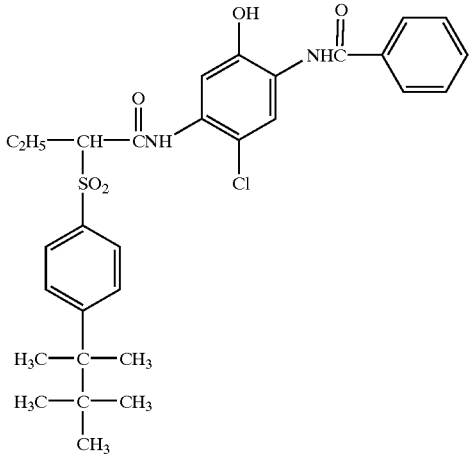
-continued
IC-20
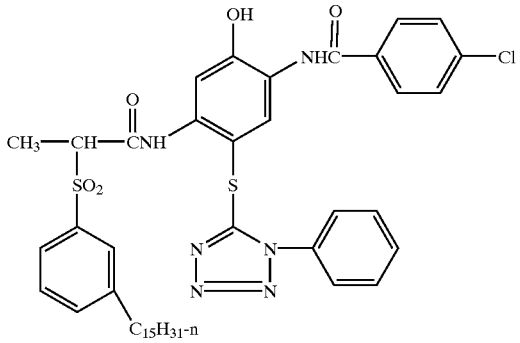
IC-21
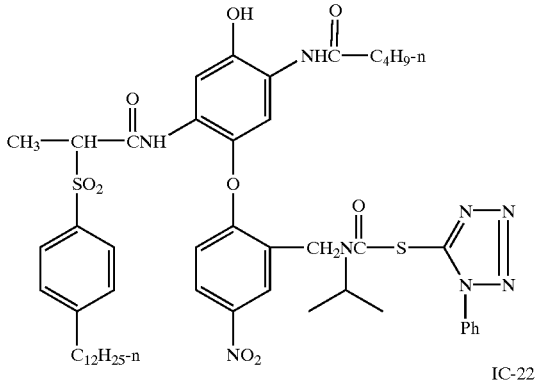
IC-22
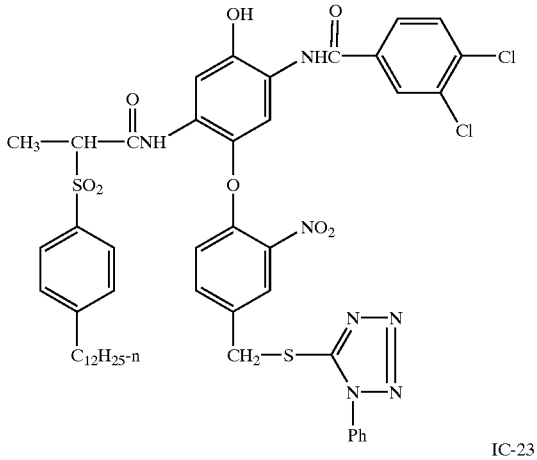
IC-23
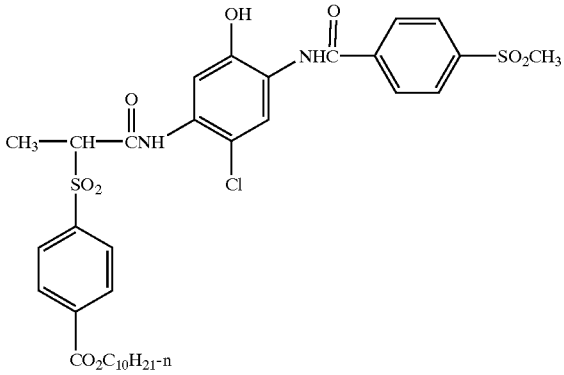

IC-24
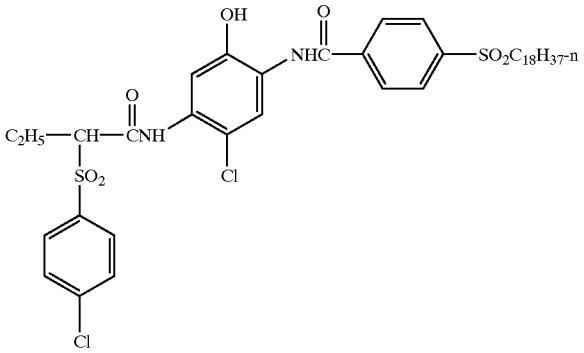
IC-25
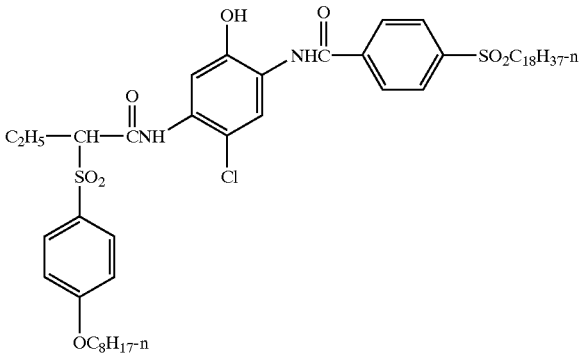
IC-26
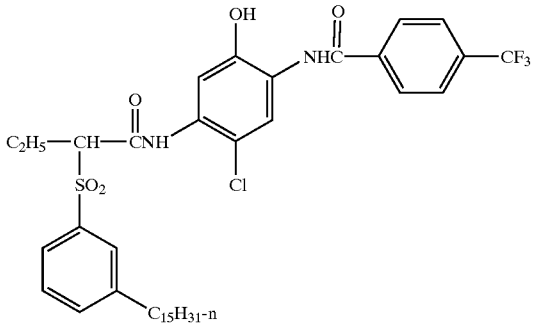
IC-27
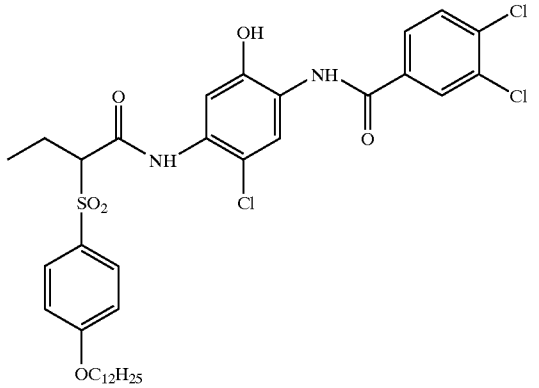
IC-28
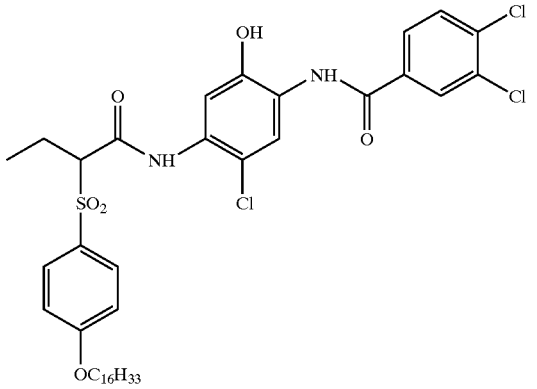
IC-29
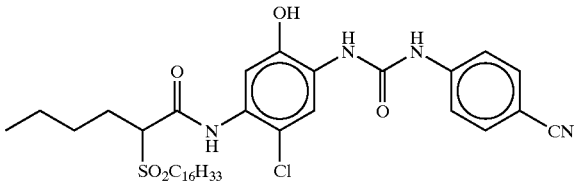
IC-30
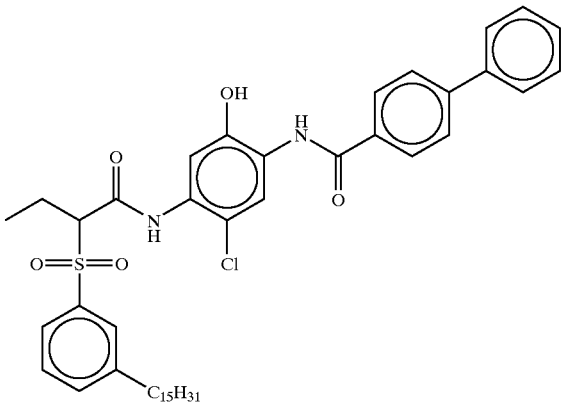
IC-31
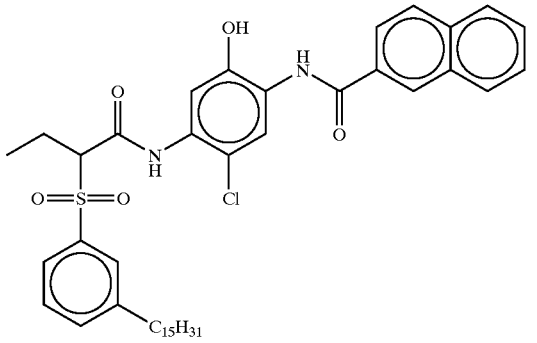

-continued

IC-32

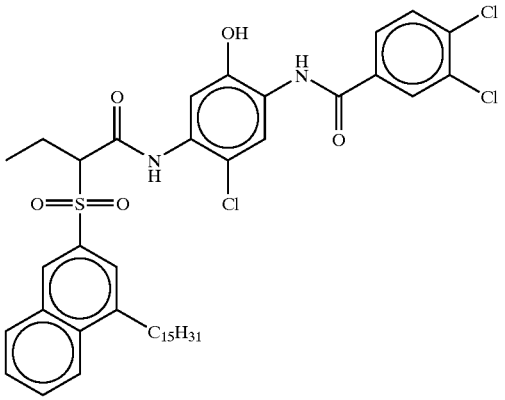

Particularly preferred cyan dye-forming couplers are IC-6, IC-27; and IC-28.

Couplers that form magenta dyes upon reaction with oxidized color developing agent are described in such representative patents and publications as: U.S. Pat. Nos. 2,311,082; 2,343,703; 2,369,489; 2,600,788; 2,908.573; 3,062,653; 3,152,896; 3,519,429; 3,758,309; and "Farbkuppler-eine literature Ubersicht," published in Agfa Mitteilungen, Band III, pp. 126–156 (1961). Preferably such couplers are pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S Pat. Nos. 4,659.652; 5,066,575; and 5,250,400.

Typical pyrazolone couplers are represented by the formulas MAGENTA-1 and MAGENTA-2 respectively

MAGENTA-1

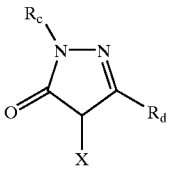

MAGENTA-2

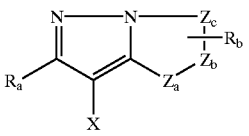

wherein $R_a$ and $R_b$ independently represents H or a substituent, $R_c$ is a substituent (preferably an aryl group); $R_d$ is a substituent (preferably an anilino carbonamido, ureido, carbamoyl, alkoxy, aryloxycarbonyl, alkoxycarbonyl, or N-heterocyclic group) X is hydrogen or a coupling-off group, and $Z_a$, $Z_b$, and $Z_c$ are independently a substituted methine group, =N—, C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

The preferred magenta dye-forming couplers used in the invention are of general formula MAGENTA-2. Specific examples of MAGENTA-2 couplers are:

M-1

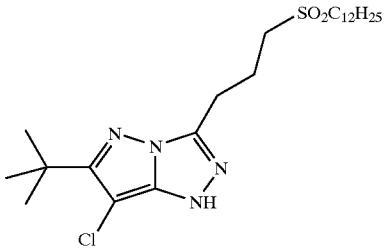

M-2

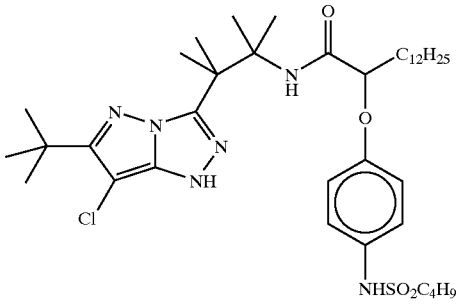

M-3

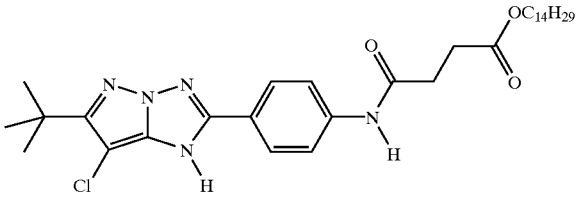

M-4

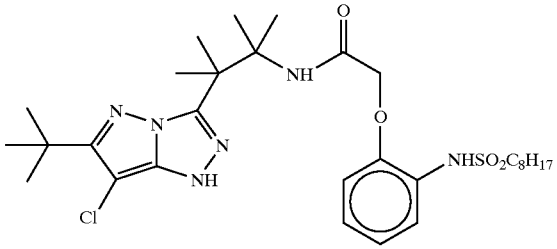

M-5

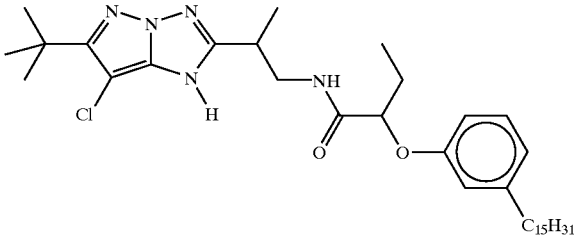

Couplers that form yellow dyes upon reaction with oxidized color developing agent are described in such representative patents and publications as: U.S. Pat. Nos. 2,298,443; 2,407,210; 2,875,057; 3,048,194; 3,265,506; 3,447,928; 3,960,570; 4,022,620; 4,443,536; 4,910,126; and 5,340,703 and "Farbkuppler-eine Literature Ubersicht," published in Agfa Mitteilungen, Band III, pp. 112–126 (1961). Such couplers are typically open chain ketomethylene compounds. Other yellow couplers such as described in, for example, European Patent Application Nos. 482,552; 510,535; 524,540; 543,367; and U.S. Pat. No. 5,238,803.

The preferred yellow dye-forming couplers used in the invention are of formula YELLOW-II:

YELLOW-II

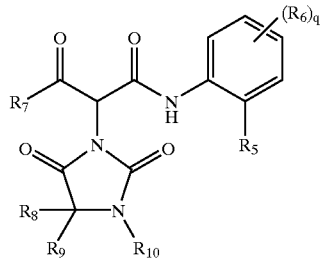

In formula YELLOW-II, $R_5$–$R_{10}$ are substituents. $R_5$ is either an alkoxy group with more than one carbon atom, aryloxy group, anilino group, arylthio group, alkylthio group, or dialkylamino group. $R_5$ groups are linked to the anilide phenyl ring by oxygen, sulfur, or nitrogen. Suitable examples or $R_5$ include phenoxy, isopropoxy, and dodecyloxy.

$R_6$ is bonded to the -3 through -6 position relative to the anilino nitrogen and is independently selected from a group consisting of hydrogen, halogen, alkoxycarbonyl (—$CO_2R$), carbamoyl (—CONRR'), carbonamido (—NRCOR'), sulfonate (—$OSO_2R$), sulfamoyl (—$SO_2NRR'$), sulfonamido (—$NRSO_2R'$), or sulfonyl (—$SO_2R$). R and R' may be hydrogen or substituted or unsubstituted alkyl or aryl groups. Suitable examples of R and R' groups are ethyl, hexadecyl, 2-ethylhexyl, p-dodecylphenyl;

q is 1 to 4;

$R_7$ is either alkyl, cyclic, or multicyclic alkyl, aryl, heterocyclic, heteroaromatic, and amine groups. Suitable examples of $R_7$ include tertiary butyl and 1-adamantyl.

$R_8$, $R_9$, and $R_{10}$, is each independently selected from the group hydrogen, alkyl, aryl, or alkoxy groups. Suitable examples of $R_8$, $R_9$, and $R_{10}$ include methyl, ethyl, benzyl, and ethoxy.

The preferred YELLOW-II couplers are those where $R_5$ is either an alkoxy group with more than one carbon atom or an aryloxy group;

$R_6$ is bonded to the -4 or -5 position relative to the anilino nitrogen and is independently selected from a group consisting of halogen, alkoxycarbonyl (—$CO_2R$), carbamoyl (—CONRR'), carbonamido (—NRCOR'), sulfonate (—$OSO_2R$), sulfamoyl (—$SO_2NRR'$), sulfonamido (—$NRSO_2R'$), or sulfonyl (—$SO_2R$). R and R' may be hydrogen or substituted or unsubstituted alkyl or aryl groups;

q is 1 or 2;

$R_7$ is either alkyl or multicyclic alkyl;

$R_8$, $R_9$ and $R_{10}$ is each independently selected from the group hydrogen, alkyl, aryl, or alkoxy groups;

and provided that each substituent for $R_5$–$R_{10}$ having a substitutable hydrogen may be substituted with a substituent selected from the group consisting of halogen, nitro, hydroxyl, cyano, carboxyl, alkyl, alkenyl alkoxy, aryl, aryloxy, carbonamido, sulonamido, sulfamoyl, carbamoyl, acyl, sulfonyl, sulfonyloxy, sulfinyl, thio, acyloxy, amine, imino, phosphate, heterocyclic group, quaternary ammonium, and silyloxy where said substituents themselves may be suitably substituted with any of the above groups.

Other yellow dye-forming couplers useful in forming chromogenic sepia images of the invention include:

Y-1

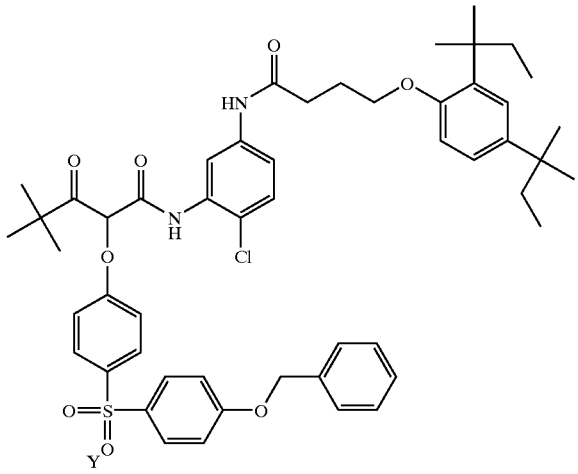

Y-2

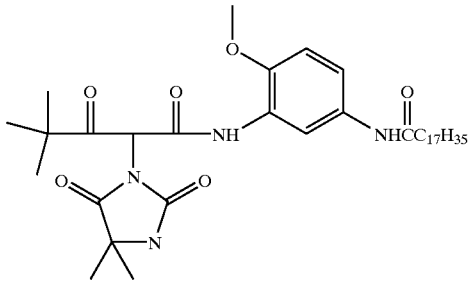

Y-3

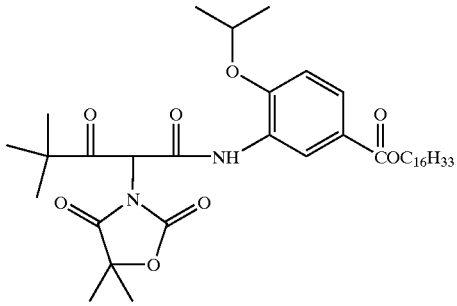

The following examples are the preferred yellow dye-forming couplers of the invention:

Y-4

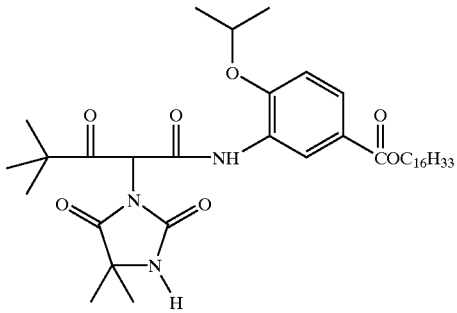

-continued

Y-5

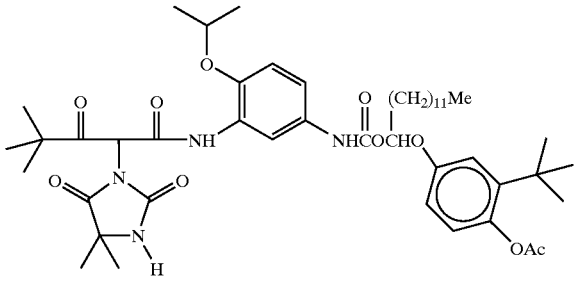

Unless otherwise specifically stated, substituent groups on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight- or branched-chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido,p-toluylsulfonamido,p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contains a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethlyammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido. carbamoyl, alkylsulfonyl, arylsulfonyl, sulfonamido, and sulfamoyl groups wherein the substituents typically contain 1 to 42 carbon atoms. Such substituents can also be further substituted.

It its preferred embodiments this invention is directed to a silver halide photographic element capable of excellent performance when exposed by either a conventional optical printing method or an electronic printing method. An electronic printing method comprises subjecting a radiation sensitive silver halide emulsion layer of a recording element to actinic radiation of at least $10^{-4}$ ergs/cm$^2$ for up to 100 micro-seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above.

The photographic emulsions useful for this invention are generally prepared by precipitating silver halide crystals in a colloidal matrix by methods conventional in the art. The colloid is typically a hydrophilic film-forming agent such as gelatin, alginic acid, or derivatives thereof The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

This invention in a preferred embodiment utilizes a radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula:

$$[ML_6]^n \quad \text{(I)}$$

wherein n is zero, -1, -2, -3, or -4, M is a filled frontier orbital polyvalent metal ion, other than iridium, and $L_6$ represents bridging ligands which can be independently selected, provided that least four of the ligands are anionic ligands, and at least one of the ligands is a cyano ligand or a ligand more electronegative than a cyano ligand, and (ii) an iridium coordination complex containing a thiazole or substituted thiazole ligand.

The combination of dopants (i) and (ii) provides greater reduction in reciprocity law failure than can be achieved with either dopant alone. Further, the combination of dopants (i) and (ii) achieve reductions in reciprocity law failure beyond the simple additive sum achieved when employing either dopant class by itself. The combination of dopants (i) and (ii) provides greater reduction in reciprocity law failure, particularly for high intensity and short duration exposures. The combination of dopants (i) and (ii) further achieves high intensity reciprocity with iridium at relatively low levels, and both high and low intensity reciprocity improvements even while using conventional gelatino-peptizer (e.g., other than low methionine gelatino-peptizer).

The emulsions and elements of the invention are well suited for conventional optical printing, as well as electronic printing method which comprises subjecting the one or more radiation sensitive silver halide emulsion layer(s) to actinic radiation of at least $10^{-4}$ ergs/cm$^2$ for up to 100$\mu$ seconds duration in a pixel-by-pixel mode.

It has previously been disclosed that significantly improved reciprocity performance can be obtained for silver halide grains (a) containing greater than 50 mole percent chloride, based on silver, and (b) having greater than 50 percent of their surface area provided by {100} crystal faces by employing a hexacoordination complex dopant of class (i) in combination with an iridium complex dopant comprising a thiazole or substituted thiazole ligand. The reciprocity improvement is obtained for silver halide grains employing conventional gelatino-peptizer, unlike the contrast improvement described for the combination of dopants set forth in U.S. Pat. Nos. 5,783,373 and 5,783,378, which requires the use of low methionine gelatino-peptizers as discussed therein, and which states it is preferable to limit the concentration of any gelatino-peptizer with a methionine level of greater than 30 micromoles per gram to a concentration of less than 1 percent of the total peptizer employed. Accordingly, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention, preferably gelatino-peptizer which comprises at least 50 weight percent of gelatin containing at least 30 micromoles of methionine per gram.

The emulsions satisfying the current invention can contain class (i) hexacoordination complex dopants satisfying the formula:

$$[ML_6]^n \quad \text{(I)}$$

wherein n is zero, -1, -2, -3, or -4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion;

$L_6$ represents six bridging ligands which can be independently selected, provided that at least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide, and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Olm et al U.S. Pat. No. 5,503,970 and Daubendiek et al U.S. Pat. Nos. 5,494,789 and 5,503,971, and Keevert et al U.S. Pat. No. 4,945,035, as well as Murakami et al Japanese Patent Application Hei-2[1990]-249588, and Research Disclosure Item 36736. Useful neutral and anionic organic ligands for class (ii) dopant hexacoordination complexes are disclosed by Olm et al U.S. Pat. No. 5,360,712 and Kuromoto et al U.S. Pat. No. 5,462,849.

Class (i) dopant is preferably introduced into the high chloride grains after at least 50 (most preferably 75 and optimally 80) percent of the silver has been precipitated, but before precipitation of the central portion of the grains has been completed Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant can be distributed throughout the interior shell region delimited above or can be added as one or more bands within the interior shell region.

Class (i) dopant can be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (i) dopants:

| | |
|---|---|
| (i-1) | $[Fe(CN)_6]^{-4}$ |
| (i-2) | $[Ru(CN)_6]^{-4}$ |
| (i-3) | $[Os(CN)_6]^{-4}$ |
| (i-4) | $[Rh(CN)_6]^{-3}$ |
| (i-5) | $[Co(CN)_6]^{-3}$ |
| (i-6) | $[Fe(pyrazine)(CN)_5]^{-4}$ |
| (i-7) | $[RuCl(CN)_5]^{-4}$ |
| (i-8) | $[OsBr(CN)_5]^{-4}$ |
| (i-9) | $[RhF(CN)_5]^{-3}$ |
| (i-10) | $[In(NCS)_6]^{-3}$ |
| (i-11) | $[FeCO(CN)_5]^{-3}$ |
| (i-12) | $[RuF_2(CN)_4]^{-4}$ |
| (i-13) | $[OsCl_2(CN)_4]^{-4}$ |
| (i-14) | $[RhI_2(CN)_4]^{-3}$ |
| (i-15) | $[Ga(NCS)_6]^{-3}$ |
| (i-16) | $[Ru(CN)_5(OCN)]^{-4}$ |
| (i-17) | $[Ru(CN)_5(N_3)]^{-4}$ |
| (i-18) | $[Os(CN)_5(SCN)]^{-4}$ |
| (i-19) | $[Rh(CN)_5(SeCN)]^{-3}$ |
| (i-20) | $[Os(CN)Cl_5]^{-4}$ |
| (i-21) | $[Fe(CN)_3Cl_3]^{-3}$ |
| (i-22) | $[Ru(CO)_2(CN)_4]^{-1}$ |

When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves, and M. T. Olm *J. Chem. Phys.,* Vol. 69, pp. 4580–7 (1978) and *Physica Status Solidi A,* Vol. 57, 429–37 (1980) and R. S. Eachus and M. T. Olm *Annu. Rep. Prog. Chem. Sect. C. Phys. Chem.,* Vol. 83, 3, pp. 3–48 (1986). The class (ii) dopants employed in the practice of this invention are believed to create such deep electron traps. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. Nos. 5,360,712 and 5,457,021 and Kuromoto et al U.S. Pat. No. 5,462,849.

In a preferred form it is contemplated to employ as a class (ii) dopant a hexacoordination complex satisfying the formula:

$$[IrL^1{}_6]^{n'} \qquad \text{(II)}$$

wherein n' is zero, -1, -2, -3, or -4; and $L^1{}_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

| | |
|---|---|
| (ii-1) | $[IrCl_5(thiazole)]^{-2}$ |
| (ii-2) | $[IrCl_4(thiazole)_2]^{-1}$ |
| (ii-3) | $[IrBr_5(thiazole)]^{-2}$ |
| (ii-4) | $[IrBr_4(thiazole)_2]^{-1}$ |
| (ii-5) | $[IrCl_5(5\text{-methylthiazole})]^{-2}$ |
| (ii-6) | $[IrCl_4(5\text{-methylthiazole})_2]^{-1}$ |
| (ii-7) | $[IrBr_5(5\text{-methylthiazole})]^{-2}$ |
| (ii-8) | $[IrBr_4(5\text{-methylthiazole})_2]^{-1}$ |

Emulsions demonstrating the advantages of the invention can be realized by modifying the precipitation of conventional high chloride silver halide grains having predominantly (>50%) {100} crystal faces by employing a combination of class (i) and (ii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For the current invention, use of bromide is typically limited to less than 10 mole percent based on silver and iodide is limited to less than 1 mole percent based on silver.

In a widely used form high chloride grains are precipitated to form cubic grains—that is, grains having {100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it has been recently observed that silver iodochloride grains with {100} crystal faces and, in some instances, one or more {111} faces offer exceptional levels of photographic speed. In these emulsions, iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 $\mu$m, preferably less than 0.2 $\mu$m, and optimally less than 0.07 $\mu$m. High chloride {100} tabular grain emulsions and their preparation are disclosed by Maskasky U.S. Pat. Nos. 5,264,337 and 5,292,632; House et al U.S. Pat. No. 5,320,938; Brust et al U.S. Pat. No. 5,314,798; and Chang et al U.S. Pat. No. 5,413,904.

Once high chloride grains having predominantly {100} crystal faces have been precipitated with a combination of class (i) and class (ii) dopants described above, chemical and spectral sensitization, followed by the addition of conventional addenda to adapt the emulsion for the imaging application of choice can take any convenient conventional form. These conventional features are illustrated by *Research Disclosure,* Item 38957, cited above, particularly:

III. Emulsion washing;
IV. Chemical sensitization;
V. Spectral sensitization and desensitization;
VII. Antifoggants and stabilizers;
VIII. Absorbing and scattering materials;
IX. Coating and physical property modifying addenda; and
X. Dye image formers and modifiers.

Some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with corner epitaxy are illustrated by Maskasky U.S. Pat. No. 5,275.930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls, and streptocyanines. In particular, it would be advantageous to select from among the low staining sensitizing dyes disclosed in U.S. Pat. Nos. 5,292,634; 5,316,904; 5,418,126; and 5,492,802. Use of low staining sensitizing dyes in a photographic element processed in a developer solution with little or no optical brightening agent (for instance, stilbene compounds such as Blankophor REU™) is specifically contemplated. Further, these low staining dyes can be used in combination with other dyes known to the art (*Research Disclosure,* September 1996, Item 38957, Section V)

Useful sensitizing dyes include, but are not limited to, the following.

BSD-1

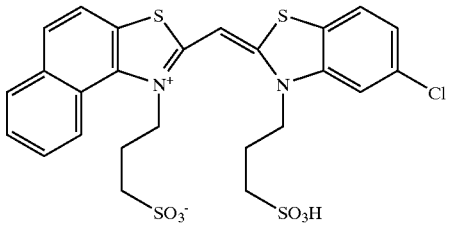

BSD-2

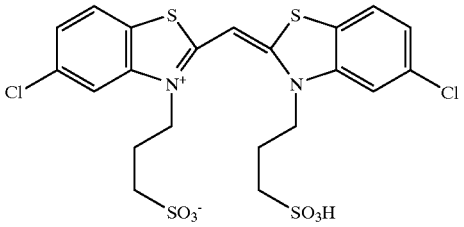

BSD-3

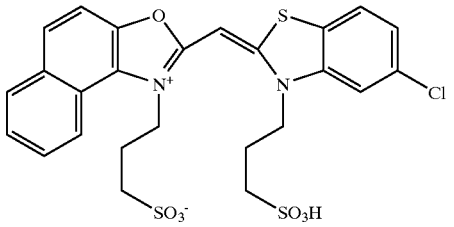

BSD-4

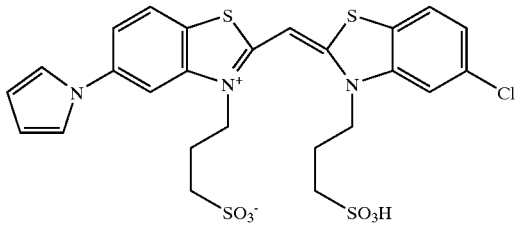

-continued

GSD-1

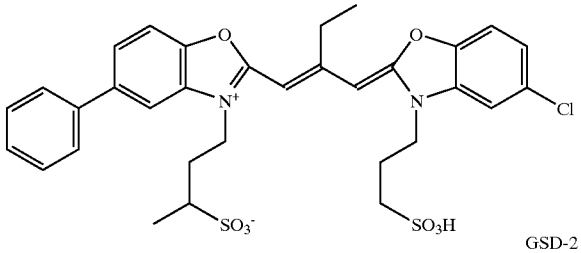

GSD-2

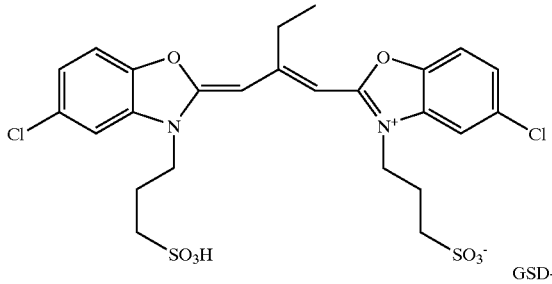

GSD-3

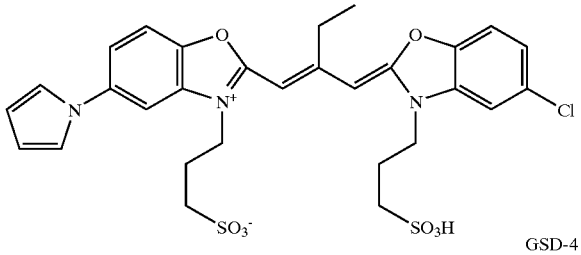

GSD-4

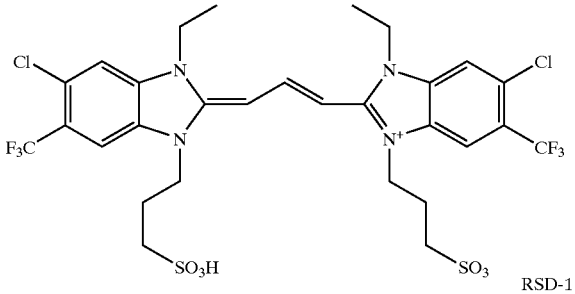

RSD-1

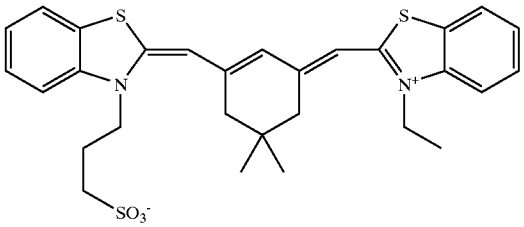

RSD-2

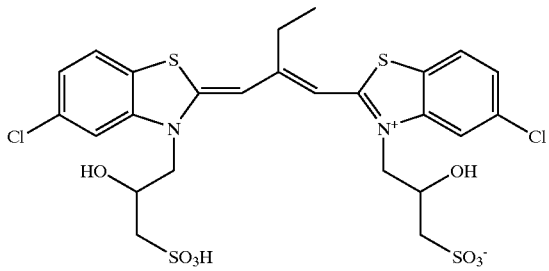

-continued

RSD-3

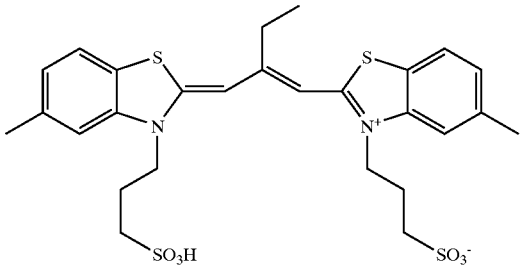

RSD-4

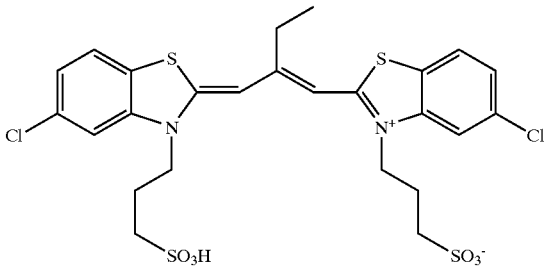

The silver halide emulsions used in the invention may be sensitized to a single color region or they may be pan-sensitized. Emulsions can also be spectrally sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue or green or red and not green plus red or blue plus red or green plus blue). Since the function of the spectral sensitizing dye is to modulate the information recorded in the negative which is recorded as an image dye, positioning the peak spectral sensitivity at or near the (λ-max) of the image dye in the color negative produces the optimum preferred response. In addition, the combination of similarly spectrally sensitized emulsions can be in one or more layers.

In the simplest contemplated form, a recording element contemplated for use in electronic printing can consist of a single emulsion layer satisfying the emulsion description provided above coated on a conventional photographic support, such as those described in *Research Disclosure,* Item 38957, cited above, XVI. Supports. In one preferred form the support is a pale yellow tinted reflective support, such as photographic paper support or a film support that contains or bears a coating of a reflective pigment. To permit a print image to be viewed using an illuminant placed behind the support, it is preferred to employ a translucent support.

It is preferred that the photographic element contain at least one stabilizer. Stabilizers and scavengers that can be used in these photographic elements, but are not limited to, are the following:

ST-1
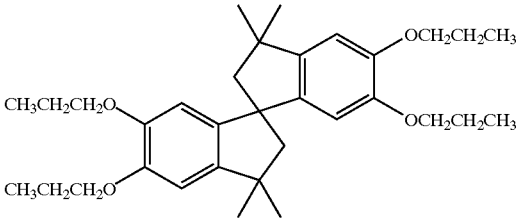
ST-2
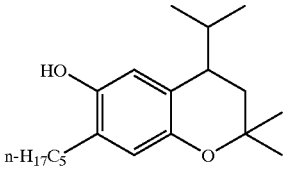
ST-3
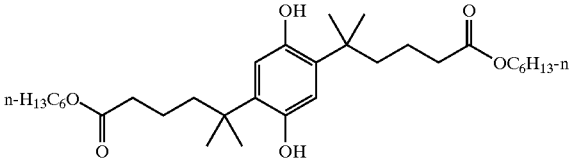
ST-4
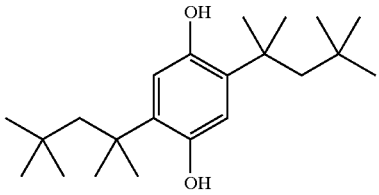
ST-5
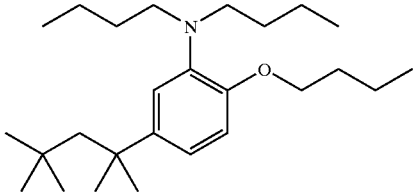
ST-6
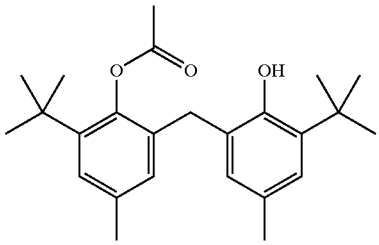
ST-7
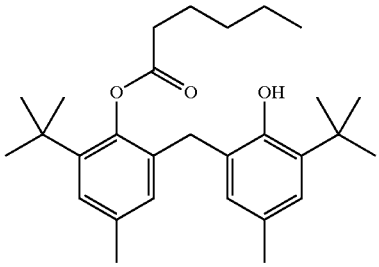
-continued
ST-8
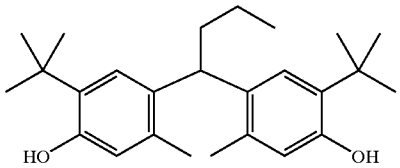
ST-9
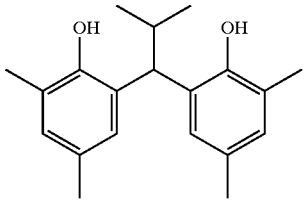
ST-10
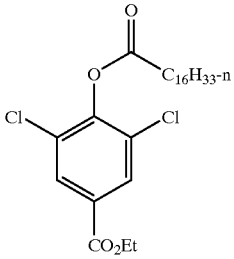
ST-11
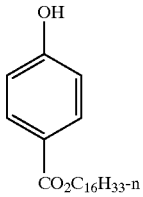
ST-12
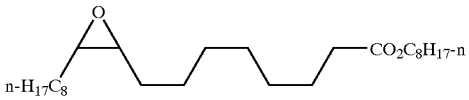
ST-13
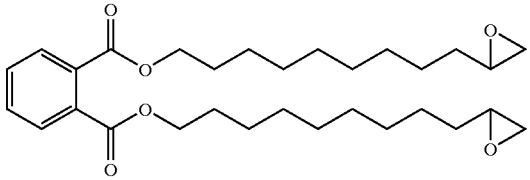
ST-14
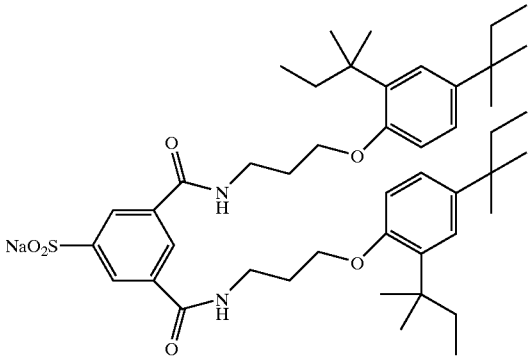

-continued

ST-15

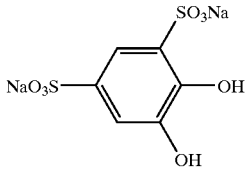

ST-16

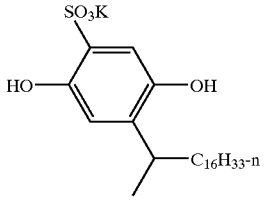

ST-17

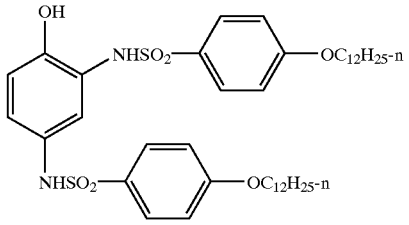

ST-18

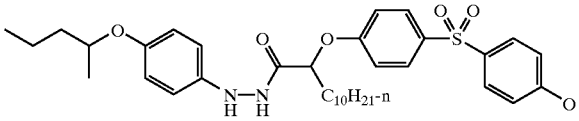

ST-19

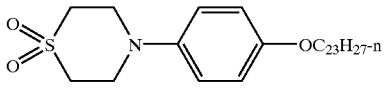

ST-20

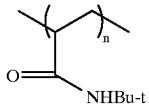

n = 75–8,000

ST-21

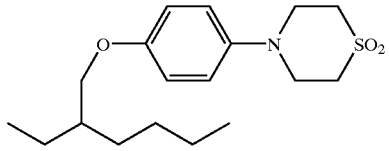

ST-22

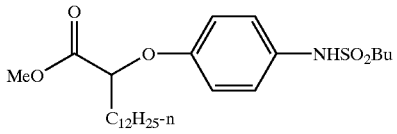

ST-23

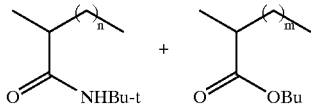

n:m 1:1 mw = 75–100,000

-continued

ST-24

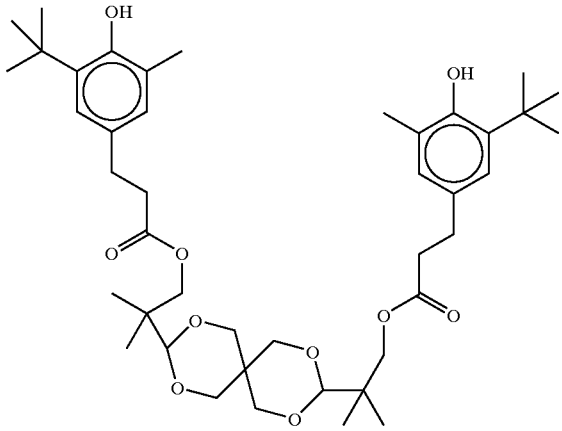

ST-25

2,5-Dihydroxy-5-methyl-3-(1-piperidinyl)-2-cyclopenten-1-one

ST-26

1-Phenyl-5-mercaptotetrazole

Examples of solvents which may be used in the invention include the following:

| | |
|---|---|
| Tritolyl phosphate | S-1 |
| Dibutyl phthalate | S-2 |
| Diundecyl phthalate | S-3 |
| N,N-Diethyldodecanamide | S-4 |
| N,N-Dibutyldodecanamide | S-5 |
| Tris(2-ethylhexyl)phosphate | S-6 |
| Acetyl tributyl citrate | S-7 |
| 2,4-Di-tert-pentylphenol | S-8 |
| 2-(2-Butoxyethoxy)ethyl acetate | S-9 |
| 1,4-Cyclohexyldimethylene bis(2-ethylhexanoate) | S-10 |
| Dibutyl sebacate | S-11 |
| Oleyl Alcohol | S-12 |
| Tributyl citrate | S-13 |

In one suitable embodiment the cyan, magenta, and yellow couplers are all combined with the same permanent solvent. Preferably the permanent solvent is tributyl citrate, oleyl alcolho, or dibutyl sebacate. In another preferred embodiment the photographic element is substantially free of development scavengers.

The dispersions used in photographic elements may also include ultraviolet (UV) stabilizers and so-called liquid UV stabilizers such as described in U.S. Pat. Nos. 4,992,358; 4,975,360; and 4,587,346. Examples of UV stabilizers are shown below.

UV-1

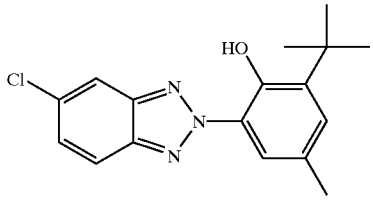

-continued
UV-2
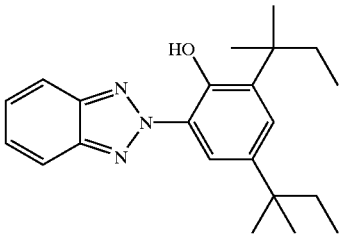
UV-3
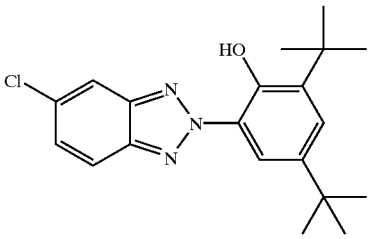
UV-4
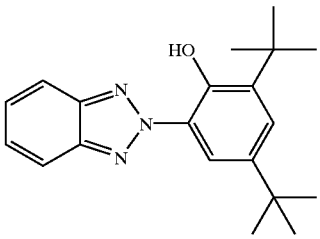
UV-5
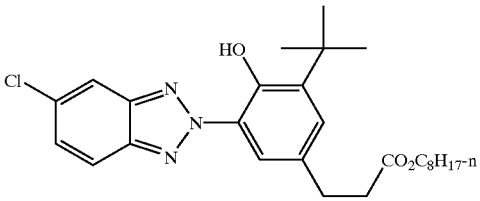
UV-6
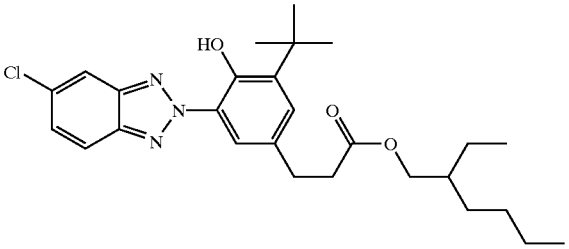
UV-7
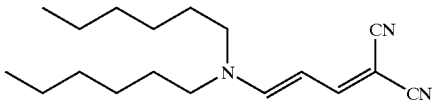
UV-8
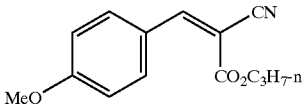
-continued
UV-9
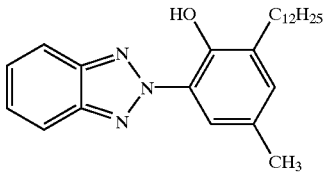
The aqueous phase may include surfactants. Surfactant may be cationic, anionic, zwitterionic, or non-ionic. Useful surfactants include, but are not limited to, the following:
SF-1
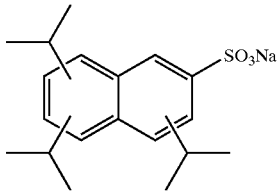
SF-2
$CF_3—(CF_2)_3—SO_3Na$
SF-3
$CH_3—(CH_2)_n—SO_3Na$, n = 12–14
SF-4
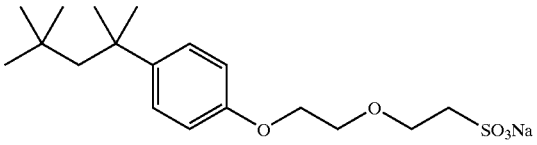
SF-5
$CH_3—(CH_2)_{11}—OSO_3Na$
SF-6
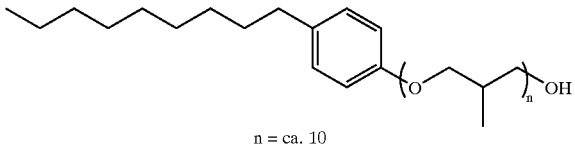
n = ca. 10
SF-7
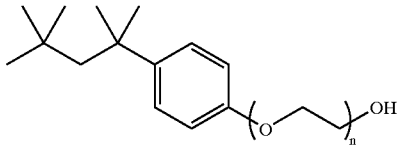
n = ca. 40
SF-8
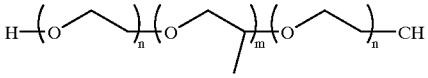
n = ca. 6, m = ca. 2
SF-9
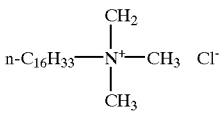

-continued

SF-10

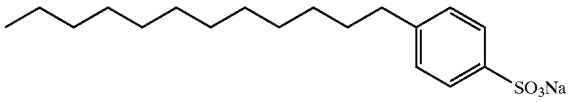

SF-11

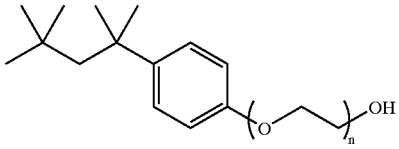

n = ca. 10

SF-12

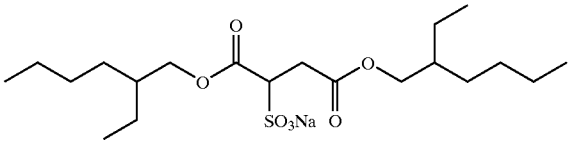

Further, it is contemplated to stabilize photographic dispersions prone to particle growth through the use of hydrophobic, photographically inert compounds such as disclosed by Zengerle et al U.S. Pat. No. 5,468,604.

The photographic elements may also contain filter dye layers comprising colloidal silver sol or yellow, cyan, and/or magenta filter dyes, either as oil-in-water dispersions, latex dispersions, or as solid particle dispersions. Useful examples of absorbing materials are discussed in *Research Disclosure,* September 1996, Item 38957, Section VIII.

The photographic elements may also contain light-absorbing materials that can increase sharpness and be used to control speed and minimum density. Examples of useful absorber dyes are described in U.S. Pat. Nos. 4,877,721; 5,001,043; 5,153,108; and 5,035,985. Solid particle dispersion dyes are described in U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; and 5,266,454. Useful dyes include, but are not limited to, the following:

DYE-1

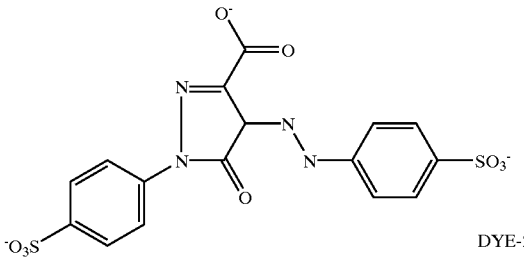

DYE-2

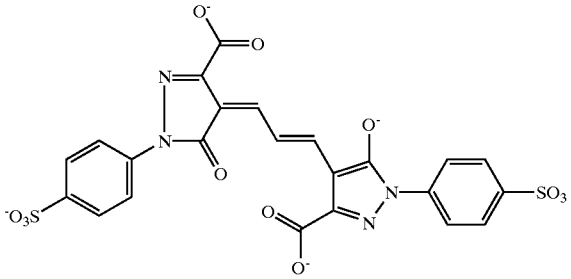

-continued

DYE-3

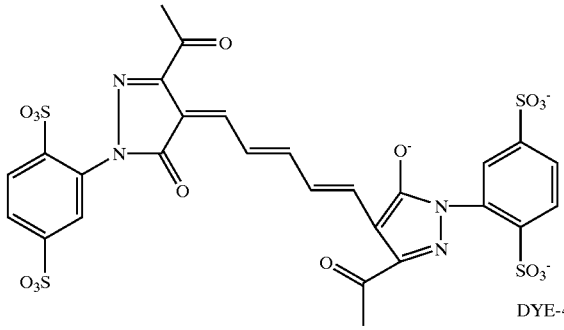

DYE-4

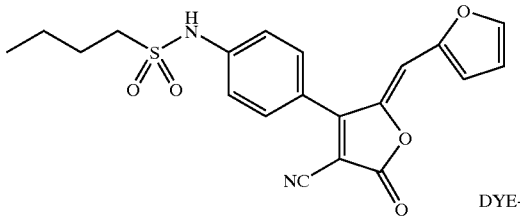

DYE-5

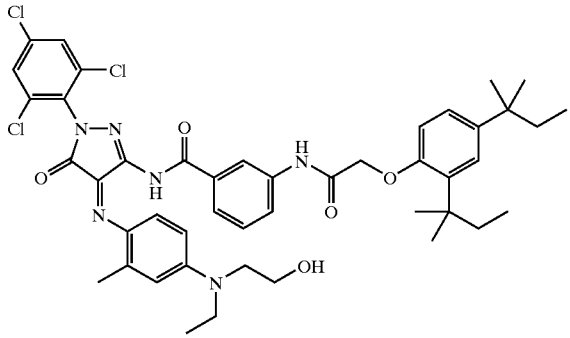

DYE-6

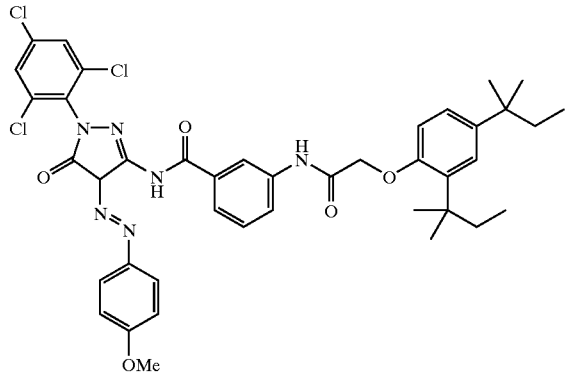

DYE-7

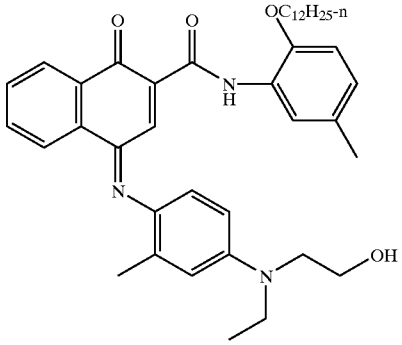

-continued

DYE-8

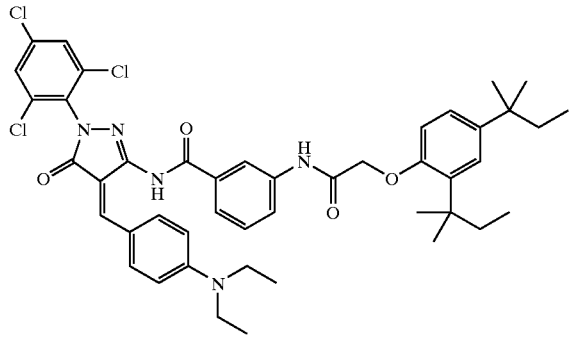

DYE-9

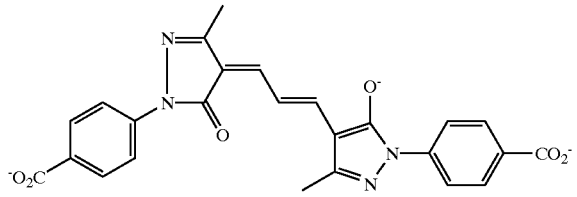

The invention employs recording elements which are constructed to contain at least one silver halide emulsion layer unit. A preferred multilayer format for a recording element used in the invention is represented by Structure 1:

STRUCTURE 1

| |
|---|
| Overcoat |
| UV Interlayer |
| Silver halide Image Layer |
| Red, Green and Blue-sensitized silver halide grains |
| Cyan, Yellow and Magenta Dye-forming couplers |
| ///// Support ///// |

wherein the red-, green-, and blue-sensitized image layer is situated nearest the support, next in order is the UV light absorbing interlayer followed by an overcoat. Silver halide emulsions satisfying the grain and gelatino-peptizer, requirements described are present in one or a combinations. Other useful multilayer formats include elements in which the red-, green-, and blue-sensitive silver halide emulsions occupy separate layers. Each structure in accordance with the invention preferably would contain at least one silver halide emulsion comprised of high chloride grains having at least 50 percent of their surface area bounded by {100} crystal faces and containing dopants from classes (i) and (ii), as described above. Preferably each of the emulsion layer units contains emulsion satisfying these criteria.

The recording elements comprising the radiation sensitive high chloride emulsion layers according to this invention can be conventionally optically printed, or can be image-wise exposed in a pixel-by-pixel mode using suitable high energy radiation sources typically employed in electronic printing methods. Suitable actinic forms of energy encompass the ultraviolet, visible, and infrared regions of the electromagnetic spectrum, as well as electron-beam radiation, and is conveniently supplied by beams from one or more light-emitting diodes or lasers, including gaseous or solid state lasers. Exposures can be monochromatic, orthochromatic, or panchromatic. For example, exposures can be provided by laser or light-emitting diode beams of appropriate spectral radiation, for example, infrared, red, green, or blue wavelengths, to which such element is sensitive. Multicolor elements can be employed which produce cyan, magenta, and yellow dyes as a function of exposure in separate portions of the electromagnetic spectrum, including at least two portions of the infared region, as disclosed in the previously mentioned U.S. Pat. No. 4,619,892. Suitable exposures include those up to 2000 nm, preferably up to 1500 nm. Suitable light emitting diodes and commercially available laser sources are known and commercially available. Imagewise exposures at ambient, elevated, or reduced temperatures and/or pressures can be employed within the useful response range of the recording element determined by conventional sensitometric techniques, as illustrated by T. H. James, *The Theory of the Photographic Process,* 4th Ed., Macmillan, 1977, Chapters 4, 6, 17, 18, and 23.

In high silver chloride emulsions, it has been observed that anionic $[MX_xY_yL_z]$ hexacoordination complexes, where M is a group 8 or 9 metal (preferably iron, ruthenium or iridium), X is halide or pseudohalide (preferably Cl, Br or CN) x is 3 to 5, Y is $H_2O$, y is 0 or 1, L is a C—C, H—C, or C—N—H organic ligand, and Z is 1 or 2, are surprisingly effective in reducing high intensity reciprocity failure (HIRF), low intensity reciprocity failure (LIRF), and thermal sensitivity variance and in improving latent image keeping (LIK). As herein employed HIRF is a measure of the variance of photographic properties for equal exposures, but with exposure times ranging from $10^{-1}$ to $10^{-6}$ second. LIRF is a measure of the variance of photographic properties for equal exposures, but with exposure times ranging from $10^{-1}$ to 100 seconds. Although these advantages can be generally compatible with face centered cubic lattice grain structures, the most striking improvements have been observed in high (>50 mole %, preferably >90 mole %) chloride emulsions. Preferred C—C, H—C, or C—N—H organic ligands are aromatic heterocycles of the type described in U.S. Pat. No. 5,462,849. The most effective C—C, H—C or C—N—H organic ligands are azoles and azines, either unsustituted or containing alkyl, alkoxy or halide substituents, where the alkyl moieties contain from 1 to 8 carbon atoms. Particularly preferred azoles and azines include thiazoles, thiazolines, and pyrazines.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$, and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100 microseconds, often up to 10 microseconds, and frequently up to only 0.5 microseconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density, and other recording element characteristics is provided in Firth et al, A Continuous-Tone Laser Color Printer, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1.

Once imagewise exposed, the recording elements can be processed in any convenient conventional manner to obtain a viewable image. Such processing is illustrated by *Research Disclosure,* Item 38957, cited above:

XVIII. Chemical development systems

XIX. Development

XX. Desilvering, washing, rinsing and stabilizing

In addition, a useful developer for the inventive material is a homogeneouos, single part developing agent. The homogeneous, single-part color developing concentrate is prepared using a critical sequence of steps:

In the first step, an aqueous solution of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from about 15:85 to about 50:50.

In this environment, especially at high alkalinity, alkali metal ions and sulfate ions form a sulfate salt that is precipitated in the presence of the hydroxy-containing organic solvent. The precipitated sulfate salt can then be readily removed using any suitable liquid/solid phase separation technique (including filtration, centrifugation, or decantation). If the antioxidant is a liquid organic compound, two phases may be formed and the precipitate may be removed by discarding the aqueous phase.

The color developing concentrates include one or more color developing agents that are well known in the art that, in oxidized form, will react with dye-forming color couplers in the processed materials. Such color developing agents include, but are not limited to, aminophenols, p-phenylenediamines (especially N,N-dialkyl-p-phenylenediamines) and others which are well known in the art, such as EP 0 434 097 A1 (published Jun. 26, 1991) and EP 0 530 921 A1 (published Mar. 10, 1993). It may be useful for the color developing agents to have one or more water-solubilizing groups Has are knows in the art. Further details of such materials are provided in *Research Disclosure,* 38957, pages 592–639 (September 1996) *Research Disclosure* is a publication of Kenneth Mason Publications Ltd., Dudley House, 12 North Street, Emsworth, Hampshire PO10 7DQ England (also available from Emsworth Design, Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 2-((4-amino-3-methlylphenyl)ethylamino)-ethanol sulfate (1:1) (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. Preferred developers are the well-known rapid color process chemistry, particularly the well-known Kodak RA-4 developer process. The RA-4 process is described in the "British Journal of Photography Annual" of 1988, pages 198–199.

In order to protect the color developing agents from oxidation, one or more antioxidants is generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones. Mixtures of compounds from the same or different classes of antioxidants can also be used if desired.

Especially useful antioxidants are hydroxylamine derivatives as described for example, in U.S. Pat. Nos. 4,892,804; 4,876,174; 5,354,646; and 5,660,974, all noted above, and U.S. Pat. No. 5,646,327 (Burns et al). Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

More preferably, the noted hydroxylamine derivatives can be mono- or dialkylhydroxylamines having one or more hydroxy substituents on the one or more alkyl groups. Representative compounds of this type are described, for example, in U.S. Pat. No. 5,709,982 (Marrese et al) as having the structure I:

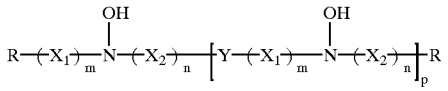

wherein

R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucicus.

$X_1$ is —$CR_2(OH)CHR_1$— and $X_2$ is —$CHR_1CR_2(OH)$— wherein $R_1$ and $R_2$ are independently hydrogen, hydroxy, a substituted Or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n, and p are independently 0 or 1. Preferably, each of m and n is I, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

It is common practice in the trade to remove the silver metal after rapid color development using bleach and fix. In the current invention, bleaching the developer silver is optional and may be substituted with a fix-only step to form an image comprised of both dye and silver.

The following examples illustrate the practice of this invention. They are not intended to be exhaustive of all possible variations of the invention. Parts and percentages are by weight unless otherwise indicated.

EXAMPLES

Standard photographic paper core was produced by refining a pulp finish of 100% bleached hardwood Kraft through a double disk refiner, then a Jordan conical refiner. To the resulting pulp finish was added 0.8% sodium stearate, 0.5% aluminum chloride; 0.15% stilbene triazine FWA, 0.2% polyamide-epichlorohydrin, 0.7% anionic polyacrylamide, and 0.6% $TiO_2$ on a dry weight basis. An about 31.5 lbs. per 1000 sq. ft. (ksf) bone dry weight base paper was made on a fourdrinier paper machine, wet pressed to a solid of 42%, and dried to a moisture of 3%, using steam-heated dryers achieving an apparent density of 0.70 g/cc. The paper base was then surface sized using a vertical size press with a 16% hydroxyethylated cornstarch solution to achieve a loading of 4.2 wt. % starch. The surface sized support was dried to a moisture of 8.8% using steam-heated dryers and calendered to an apparent density of 1.08 gm/cc.

The support was then tinted as follows: A resin concentrate was formed according to the compositions listed below for Support A (comparison) and Support B (invention). The resin blend was extrusion coated on the cellulose paper at a lay down of 24.4 g/m$^2$.

Support A. (Comparison)

The tinted resin for support A has the following composition.

| Name | % of item |
|---|---|
| D4002-P Low Density Polyethylene | 83.9% |
| Titanium Dioxide (Anatase form of $TiO_2$) | 12.5% |
| Zinc oxide | 3.0% |
| *Cobalt Blue (Cobalt Aluminate) | 0.17% |
| *Fast Pink R-114 (2,9 Dimethylquinacridone) | <0.01% |
| Irganox 1076 | 0.09% |
| Calcium stearate | 0.50% |
| Optical Brightener (Hostalux KS) | 0.05% |

*Approximate amount needed to meet color aim.

Pigments were adjusted to meet the following colorimetric aims:

| | | | |
|---|---|---|---|
| Texture Surface | L* 93.75 | a* −0.30 | b* −3.00 |
| Glossy surface | L* 93.55 | a* −0.50 | b* −3.50 |

Support B. (Invention)

The tinted resin for Support B has the following composition:

| Name | % of item |
|---|---|
| D4002-P Low Density Polyethylene | 82.32 |
| Titanium Dioxide (Rutile form) | 12.0 |
| Zinc oxide | 5.0 |
| *Cobalt Blue | <0.1 |
| *Fast Pink R-114 (2,9 Dimethylquinacridone) | <0.1 |
| Irganox 1076 | 0.10 |
| Calcium stearate | 0.50 |
| *Yellow 110 Pigment (Irgazin Yellow 3RLTN, Ciba-Geigy) | <0.10 |

*Approximate amount needed to meet color aim.

The blue, pink, and yellow pigments were adjusted to meet the following colorimetric aims:

| | | | |
|---|---|---|---|
| Textured Surface | L* 95.22 | a* 0.15 | b* 1.70 |

The Colorimetric measurements were made with a Hunter Ultrascan, backed by black, UV light filtered out, with a xenon light source (D65 simulation).

Silver chloride emulsions were chemically and spectrally sensitized as described below. A biocide comprising a mixture of N-methyl-isothiazolone and N-methyl-5-chloroisthiazolone was added after sensitization.

Blue Sensitive Emulsion (Blue EM-1): A high chloride silver halide emulsion was precipitated by adding approximately equimolar silver nitrate and sodium chloride solutions into a well-stirred reactor containing glutaryldiaminophenyldisulfide. gelatin peptizer, and thioether ripener. Cesium pentachloronitrosylosmate(II) dopant was added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contained cubic-shaped grains having edge length of 0.6 $\mu$m. The emulsion was optimally sensitized by the addition of a colloidal suspension of aurous sulfide and heat ramped to 60° C., during which time blue sensitizing dye BSD-4. potassium hexchloroiridate, Lippmann bromide, and 1-(3-acetamidophenyl)-5-mercaptotetrazole were added.

Green Sensitive Emulsion (Green EM-1): A high chloride silver halide emulsion was precipitated by adding approximately equimolar silver nitrate and sodium chloride solutions into a well-stirred reactor containing, gelatin peptizer, and thioether ripener. Cesium pentachloronitrosylosmate(II) dopant was added during the silver halide grain formation for most of the precipitation, followed by the addition of potassium (5-methylthiazole)-pentachloroiridate. The resultant emulsion contained cubic shaped grains of 0.3 $\mu$m in edge length size. The emulsion was optimally sensitized by the addition of glutaryldiaminophenyldisulfide, a colloidal suspension of aurous sulfide and heat ramped to 55° C., during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. During the silver halide grain formation, potassium hexacyanoruthenate(II) and potassium (5-methylthiazole)-pentachloroiridate were added. The resultant emulsion to contained cubic shaped grains of 0.4 μm in edge length size. The emulsion was optimally sensitized by the addition of glutaryldiaminophenyldisulfide, sodium thiosulfate. tripotassium bis{2-[3-(2-sulfobenzamido)phenyl]-mercaptotetrazole}gold(1) and heat ramped to 64° C., during which time 1-(3-acetamidophenyl)-5-mercaptotetrazole, potassium hexachloroiridate, and potassium bromide were added. The emulsion was then cooled to 40° C., pH adjusted to 6.0. and red sensitizing dye RSD-1 was added.

Red Sensitive Emulsion (Red EM-2): A high chloride silver halide emulsion was precipitated by adding approximately equimolor silver nitrate and sodium chloride solutions into a well-stirred reactor containing gelatin peptizer and thioether ripener. Potassium hexacyanoruthenate was added to the make. The resultant emulsion contained cubic grains of 0.37 μm in edge length size. The emulsion was first false sensitized with a green sensitizing dye, GSD-1, followed by sensitization with a colloidal suspension of aurous sulfide. This was followed by a heat ramp to 65° C., held for 5 minutes, then cooled back to 45° C. After another heat ramp to 65° C., 1-(3-acetamidophenyl)-5-mercaptotetrazole, stilbene, a combination of potassium tolylthiosulfonate and the sodium tolylsulfinate, potassium hexachloroiridate, and potassium bromide were added. After cooling to 45° C., the red sensitizing dye, RSD-1, was added. This was followed by addition of the red absorber dye, DYE-3. At the end of the extended post finish, the pH was adjusted to 6.5.

Coupler Dispersions 1–5, used in the invention and comparison examples, were prepared by methods well known in the art. Couplers, stabilizers, and solvents were combined at 140° C. and emulsified in aqueous gelatin. Component amounts and final concentrations in gel wt %, oil wt % and coupler wt % are listed in Table 1.

TABLE 1

| | Dispersion 1 kgs | Dispersion 2 kgs | Dispersion 3 kgs | Dispersion 4 kgs | Dispersion 5 kgs |
|---|---|---|---|---|---|
| IC-27 | 0.2188 | 0.1875 | 0.1563 | 0.1406 | 0.1250 |
| M-4 | 0.6875 | 0.6875 | 0.6719 | 0.6719 | 0.6719 |
| Y-4 | 1.0000 | 1.0000 | 1.0000 | 1.0000 | 1.0000 |
| ST-24 | 0.2906 | 0.2906 | 0.2906 | 0.2906 | 0.2906 |
| ST-22 | 0.2969 | 0.2969 | 0.2969 | 0.2969 | 0.2969 |
| ST-21 | 0.1500 | 0.1500 | 0.1500 | 0.1500 | 0.1500 |
| Tributylcitrate | 1.0879 | 1.0751 | 1.0558 | 1.0493 | 1.0429 |
| Oleyl alcohol | 1.0879 | 1.0751 | 1.0558 | 1.0493 | 1.0429 |
| % IC-27 | 0.83 | 0.72 | 0.61 | 0.55 | 0.49 |
| % M-4 | 2.61 | 2.64 | 2.63 | 2.64 | 2.66 |
| % Y-4 | 3.80 | 3.84 | 3.91 | 3.94 | 3.96 |
| % gel | 7.41 | 7.41 | 7.41 | 7.41 | 7.41 |
| | 7.41 | 7.41 | 7.41 | 7.41 | 7.41 |
| % oil | 18.29 | 18.29 | 18.29 | 18.29 | 18.29 |

Comparison Example 1 was prepared by coating Dispersion 1 in a photographic multilayer on Support A, a standard "white" photographic paper support. Layers and component lay downs in Comparison Example 1 are listed in Multilayer Structure 1. Comparison Examples 2–5 were prepared by substituting Dispersion 1 with Dispersions 2–5 respectively in Multilayer Structure 1, maintaining the Y-4 lay down at 0.715 g/m$^2$ in each coating.

Inventive Examples 1–5 were prepared by coating the same multilayer structures as in Comparison Examples 1–5 on Support B, a yellow tinted photographic paper support.

Multilayer Structure 1
Comparison Example 1, Prepared with Dispersion 1

| | g/m$^2$ |
|---|---|
| Layer 1: Red Light Sensitive Layer | |
| Gelatin | 4.359 |
| Red Light Sensitive Silver Red EM-2 | 0.409 |
| | 0.409 |
| Green light sensitive silver Green EM-1 | 0.161 |
| Blue light sensitive silver Blue EM-1 | 0.054 |
| IC-27 | 0.179 |
| M-4 | 0.492 |
| Y-4 | 0.715 |
| 5-chloro-2-methyl-4-isothiazolin-3-one/2-methyl-4-isothiazolin-3-one(3/1) | 0.005 |
| Tributylcitrate | 0.769 |
| S-12 | 0.769 |
| ST-21 | 0.107 |
| ST-22 | 0.212 |
| ST-24 | 0.208 |
| SF-1 | 0.138 |
| ST-26 | 0.002 |
| ST-25 | 0.00062 |
| ST-16 | 0.009 |
| DYE-1 | 0.013 |
| DYE-2 | 0.006 |
| Layer 2: UV Dye Interlayer | |
| Gelatin | 0.861 |
| UV-9 | 0.753 |
| Bis-vinylsulfonylmethane | 0.115 |
| Copoly-acrylamide: 1-Propanesulfonic acid, 2-methyl-2-((1-oxo-2-propenyl)amino)-, monosodium salt 20.80 w/w | .056 |
| Layer 3: Overcoat | |
| Gelatin | 0.646 |
| Poly-DimethylSiloxane | 0.020 |
| Tergitol-15-S-5 | 0.002 |
| Ludox AM (colloidal silica) | 0.164 |
| SF-1 | 0.008 |
| SF-2 | 0.003 |

Exposures

Conventional separation exposures were made by contact printing for 0.5 second through a carbon step tablet with red separation filters, each step separated by 0.15 log exposure increments. Images were processed in standard RA-4 chemistry. The status A red, green, and blue density of each neutral step was measured and plotted against relative log exposure units to produce the corresponding red, green, and blue dye curves of the neutral. Speed was measured as the relative log exposure required to produce a density=0.8 in each dye curve.

CIELAB measurements were made with an Xrite Spectrophotometer at D5000.

Test Results

Table 2 lists the a* and b* values of the red separation of Comparison coatings 1–5 on Support A and Inventive coatings 6–10 on Support B at L* values of 25, 50, 75, and 90.

| | L* = 25 a*, b* | L* = 50 a*, b* | L* = 75 a*, b* | L* = 90 a*, b* |
|---|---|---|---|---|
| Comparison Ex. 1 | 12.5, 13.0 | 9.0, 12.4 | 4.8, 6.0 | 1.3, −1.2 |
| Comparison Ex. 2 | 17.7, 14.8 | 12.2, 13.8 | 6.3, 6.8 | 1.5, −1.4 |
| Comparison Ex. 3 | 22.0, 17.8 | 14.7, 16.3 | 7.4, 8.0 | 1.5, −1.0 |
| Comparison Ex. 4 | 24.8, 19.3 | 17.0, 17.6 | 8.4, 8.4 | 1.3, −1.5 |
| Comparison Ex. 5 | 27.8, 21.5 | 19.0, 19.0 | 13.8, 13.8 | 1.6, −1.0 |

-continued

| | L* = 25 a*, b* | L* = 50 a*, b* | L* = 75 a*, b* | L* = 90 a*, b* |
|---|---|---|---|---|
| Invention Ex. 1 | 13.4, 13.4 | 9.4, 14.5 | 5.2, 10.5 | 1.2, 6.2 |
| Invention Ex. 2 | 17.9, 15.5 | 12.5, 15.7 | 7.0, 11.2 | 2.0, 6.5 |
| Invention Ex. 3 | 22.5, 18.5 | 15.8, 18.3 | 8.3, 13.1 | 2.3, 7.1 |
| Invention Ex. 4 | 25.3, 20.0 | 16.5, 19.3 | 9.3, 13.2 | 2.5, 9.4 |
| Invention Ex. 5 | 28.5, 22.0 | 20.0, 21.0 | 10.0, 13.5 | 2.2, 7.0 |

The comparison and invention examples were also exposed through various scene negatives and processed in RA-4 chemistry. The yellow tint in Support B lowers the visual contrast between the background Dmin and the brown-or-orange hue of the sepia image in Invention Examples 1–5. Each of the coatings with a positive b* at L*=90 had superior overall image quality compared to the Comparison examples 1–5. Invention Examples 1–5 also exhibit negligible staining in the minimum density areas, have excellent light stability, and develop to a high density when digitally exposed (raster scanned) at 1000 nanoseconds per pixel. The most preferred sepia hue was produced by Dispersions 1 and 2.

The invention has been described in detail with particular reference to certain preferred embodiments thereof, but it will be understood that variations and modifications can be effected within the spirit and scope of the invention.

What is claimed is:

1. A silver halide photographic element for forming a sepia image comprising a support and an image forming layer which contains a cyan dye forming coupler, a magenta dye forming coupler, and a yellow dye forming coupler, wherein the support has CIELAB a* and b* values within the following ranges at L*>90:0<b*<6.0, 0<a*<1.0; and wherein the image formed after exposure and development of the photographic element has CIELAB a* and b* values within the following ranges at each of the specified L* levels;

| | | |
|---|---|---|
| L* = 90 | 0 < a* < 2 | 4 < b* < 8 |
| L* = 75 | 4 < a* < 8 | 8 < b* < 12 |
| L* = 50 | 6 < a* < 10 | 12 < b* < 18 |
| L* = 25 | 10 < a* < 16 | 12 < b* < 20 |

2. The silver halide photographic element of claim 1 wherein the image formed after exposure and development of the photographic element has CIELAB a* and b* values within the following ranges at each of the specified L* levels;

| | | |
|---|---|---|
| L* = 90 | 0 < a* < 2 | 4 < b* < 8 |
| L* = 75 | 4 < a* < 8 | 8 < b* < 12 |
| L* = 50 | 6 < a* < 10 | 12 < b* < 18 |
| L* = 25 | 10 < a* < 16 | 12 < b* < 20. |

3. The silver halide photographic element of claim 1 wherein the support has CIELAB a* and b* values within the following ranges at L*>90:0<b*<2.5, 0<a*<0.8.

4. The silver halide photographic element of claim 2 wherein the support has CIELAB a* and b* values within the following ranges at L*>90:0<b*<2.5, 0<a*<0.8.

5. The silver halide photographic element of claim 1 wherein the support is tinted with colorants.

6. The silver halide photographic element of claim 1 wherein the support does not contain an optical brightener.

7. The silver halide photographic element of claim 1 wherein the magenta dye-forming coupler is represented by formula MAGENTA-2:

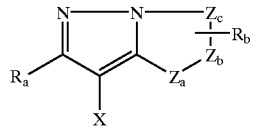

wherein $R_a$ and $R_b$ independently represent H or a substituent; X is hydrogen or a coupling-off group, and $Z_a$, $Z_b$, and $Z_c$ are independently a substituted methine group, =N—, =C—, or —NH—; provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and provided that at least one of $Z_a$, $Z_b$, and $Z_c$ represents a methine group connected to the group $R_b$; and the yellow dye-forming coupler is represented by formula YELLOW-II:

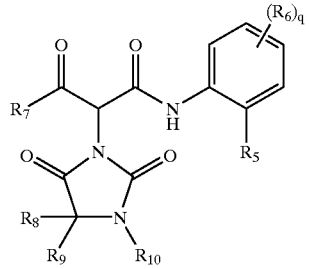

wherein:

$R_5$ is an alkoxy group with more than one carbon atom, or an aryloxy, anilino, arylthio, alkylthio, or dialkylamino group and the $R_5$ group is linked to the anilide phenyl ring by the oxygen, sulfur or nitrogen atom, $R_6$ is bonded to the -3 through -6 position relative to the anilino nitrogen and is independently selected from a hydrogen or halogen atom, or an alkoxycarbonyl (—$CO_2R$), carbamoyl (—CONRR'), carbonamido (—NRCOR'), sulfonate (—$OSO_2R$), sulfamoyl (—$SO_2NRR'$), sulfonamido (—$NRSO_2R'$), or sulfonyl (—$SO_2R$) group with R and R' being a hydrogen or a substituted or unsubstituted alkyl or aryl group;

q is 1 to 4;

$R_7$ is an alkyl, cyclic or multicyclic alkyl, aryl, heterocyclic, heteroaromatic, or amine group; and $R_8$, $R_9$, and $R_{10}$ are each independently a hydrogen, or an alkyl, aryl, or alkoxy group.

8. The photographic element of claim 7 wherein in said yellow dye-forming coupler YELLOW-II $R_5$ is either an alkoxy group with more than one carbon atom or an aryloxy group;

$R_6$ is bonded to the -4 or -5 position relative to the anilino nitrogen and is independently a halogen, or an alkoxycarbonyl (—$CO_2R$), carbamoyl (—CONRR'), carbonamido (—NRCOR'), sulfonate (—$OSO_2R$), sulfamoyl (—SO2NRR'), sulfonamido (—NRSO2R'), or sulfonyl (—$SO_2R$) group with R and R' being a hydrogen or a substituted or unsubstituted alkyl or aryl group;

q is 1 or 2;

$R_7$ is either an alkyl or multicyclic alkyl group; and $R_8$, $R_9$ and $R_{10}$ are each independently a hydrogen, or an alkyl, aryl, or alkoxy group.

9. The photographic element of claim 7 wherein said yellow dye-forming coupler is Y1—Y3, Y4 or Y5:

Y-1

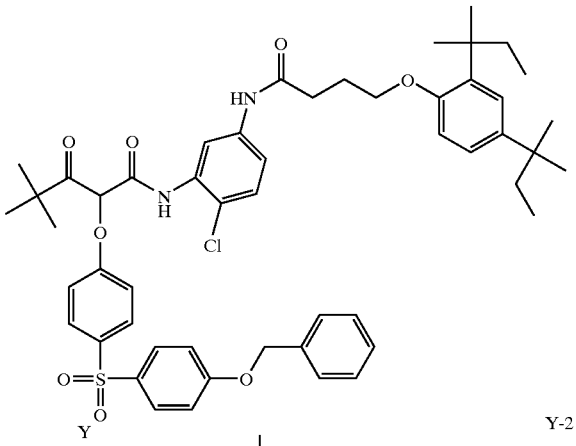

Y-2

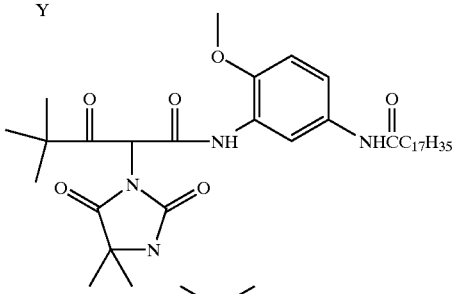

Y-3

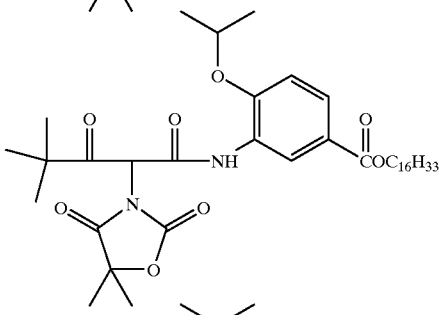

Y-4

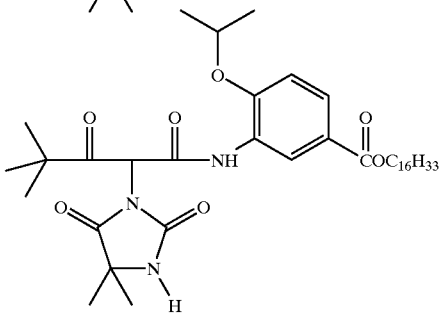

Y-5

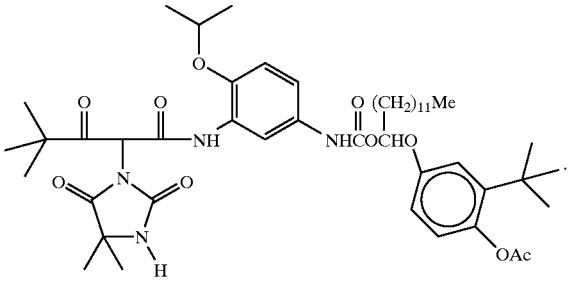

10. The photographic element of claim 7 wherein the magenta dye-forming coupler is

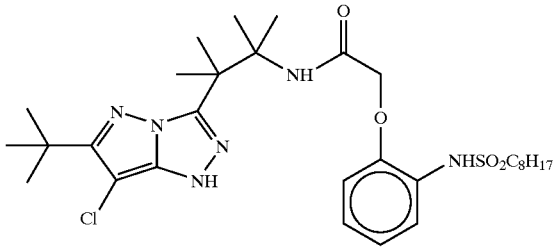

11. The photographic element of claim 7 wherein said cyan dye-forming coupler is represented by general formula CYAN-5:

CYAN-5

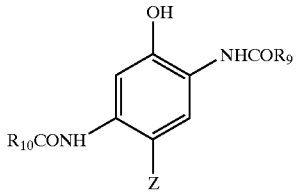

wherein $R_9$ and $R_{10}$ are independently an unsubstituted or substituted alkyl, aryl, amino, alkoxy or heterocyclyl group, and Z is a hydrogen atom or a group which can be split off by the reaction of the coupler with an oxidized color developing agent.

12. The photographic element of claim 7 wherein said cyan dye-forming coupler is represented by general formula CYAN-5A:

CYAN-5A

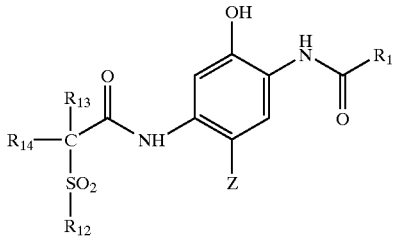

wherein $R_{11}$ and $R_{12}$ are independently an unsubstituted or substituted alkyl, aryl, amino, alkoxy, or heterocyclyl group, $R_{13}$ and $R_{14}$ are independently hydrogen or an unsubstituted or substituted alkyl group, and Z is a hydrogen atom or a group which can be split off by the reaction of the coupler with an oxidized color developing agent.

13. The photographic element of claim 7 wherein said cyan dye-forming coupler is

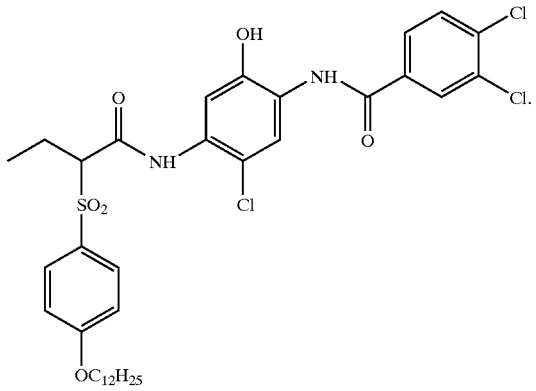

14. The photographic element of claim 1 wherein the image forming unit comprises three photosensitive layers.

15. The photographic element of claim 1 wherein the image forming unit comprises one photosensitive layer.

16. The photographic element of claim 1 wherein said element comprises photosensitive silver halide grains that have been sensitized to a single color region.

17. The photographic element of claim 1 wherein said element comprises photosensitive silver halide grains that have been pan-sensitized.

18. The photographic element of claim 1 wherein said element comprises photosensitive silver halide grains comprising greater than 90 percent silver chloride.

19. The photographic element of claim 1 wherein said element is processable in rapid access color development chemistry suitable for silver chloride development.

20. The photographic element of claim 1 wherein said element is substantially free of developer scavengers.

21. The photographic element of claim 1 wherein the cyan, magenta, and yellow couplers all are combined with the same permanent solvent.

22. The photographic element of claim 21 wherein said permanent solvent comprises at least one member selected from the group consisting of tributyl citrate, oleyl alcohol, and dibutyl sebacate.

23. The photographic element of claim 1 further comprising at least one stabilizer.

24. The photographic element of claim 1 wherein said element has a digital compatibility such that when exposed with a scanning device, it is capable of producing after development a blue and green density of at least 1.5 without significant banding or fringing artifacts.

25. The silver halide photographic element of claim 4 wherein the magenta dye-forming coupler is represented by formula MAGENTA-2:

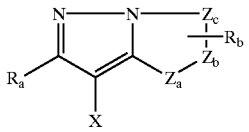

wherein $R_a$ and $R_b$ independently represent H or a substituent; X is hydrogen or a coupling-off group, and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and provided that at least one of $Z_a$, $Z_b$, and $Z_c$ represents a methine group connected to the group $R_b$, and the yellow dye-forming coupler is represented by formula YELLOW-II,

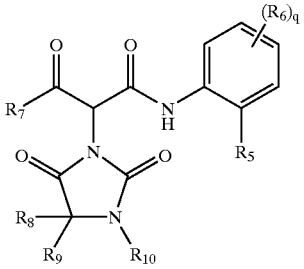

wherein:

$R_5$ is an alkoxy group with more than one carbon atom, or an aryloxy, anilino, arylthio, alkylthio, or dialkylamino group and the $R_5$ group is linked to the anilide phenyl ring by the oxygen, sulfur, or nitrogen atom;

$R_6$ is bonded to the -3 through -6 position relative to the anilino nitrogen and is independently selected from a hydrogen or halogen atom, or an alkoxycarbonyl (—$CO_2R$), carbamoyl (—CONRR'), carbonamido (—NRCOR'), sulfonate (—$OSO_2R$), sulfamoyl (—$SO_2NRR'$), sulfonamido (—$NRSO_2R'$), or sulfonyl (—$SO_2R$) group with R and R' being a hydrogen or a substituted or unsubstituted alkyl or aryl group, q is 1 to 4;

$R_7$ is an alkyl, cyclic or multicyclic alkyl, aryl, heterocyclic, heteroaromatic, or amine group, and $R_8$, $R_9$, and $R_{10}$ are each independently a hydrogen, or an alkyl, aryl, or alkoxy group.

26. A silver halide photographic element for forming a sepia image comprising a support and an image forming layer which contains a cyan dye forming coupler, a magenta dye forming coupler, and a yellow dye forming coupler wherein the support has CIELAB a* and b* values within the following ranges at L*>90:0<b*<6.0, 0<a*<1.0.

27. The silver halide photographic element of claim 26 wherein the support has CIELAB a* and b* values within the following ranges at L*>90:0<b*<2.5, 0<a*<0.8.

* * * * *